US005820707A

United States Patent [19]

Amick et al.

[11] Patent Number: 5,820,707

[45] Date of Patent: Oct. 13, 1998

[54] COMPOSITE ARTICLE, ALLOY AND METHOD

[75] Inventors: Darryl Dean Amick, Albany; John C. Haygarth, Corvallis; Hershel R. Henson, Albany, all of Oreg.; Sarit Behari Bhaduri, Moscow, Id.; Kent Wayne Storey, Spokane, Wash.

[73] Assignee: Teledyne Industries, Inc., Albany, Oreg.

[21] Appl. No.: 693,225

[22] PCT Filed: Mar. 17, 1995

[86] PCT No.: PCT/US95/03314

§ 371 Date: Aug. 21, 1996

§ 102(e) Date: Aug. 21, 1996

[87] PCT Pub. No.: WO95/25183

PCT Pub. Date: Sep. 21, 1995

[51] Int. Cl.[6] ..... C22C 14/00

[52] U.S. Cl. ..... 148/669; 148/421; 501/134

[58] Field of Search ..... 148/669; 501/134

[56] References Cited

U.S. PATENT DOCUMENTS

| | | | |
|---|---|---|---|
| 2,892,706 | 6/1959 | Jaffee | 75/175.5 |
| 2,987,352 | 6/1961 | Watson | 308/241 |
| 3,370,946 | 2/1968 | Bertea | 75/175.5 |
| 3,643,658 | 2/1972 | Steinemann et al. | 128/92 |

(List continued on next page.)

FOREIGN PATENT DOCUMENTS 2703529 8/1978 Germany .

OTHER PUBLICATIONS

Wyder, W. et al., "The System Niobium–Titanium–Zirconium Oxygen at 1500° C." *Trans. Metallurg. Soc.,* AIME, vol. 224, 1962, pp. 373–378.

Zwicker et al., Z. Metallkunde, 61, 1970, pp. 836–847.

Collins, (ed.) A Sourcebook of Titanium Alloy Superconducting, Plenum, NY, 1983, pp. 342, 352, 357, 358, 366 and 405–419.

Albert et al., Z Metallkunde, 63, 1972, p. 126.

Brown and Merritt, "Evaluation of Corrosion Resistance of Biology", Case Western Reserve University, Feb. 13, 1986 (1:8).

Mears, "Electron–Probe Microanalysis of Tissue & Cells from Implant Areas", Journal of Bone & Joint Surgery, vol. 48B, No. 3, pp. 567–576.

Ferguson et al., "The Ionization of Metal Implants in Living Tissues", Journal of Bone & Joint Surgery, vol. 42A, No. 1, pp. 77–90.

Jepson et al., The Science & Tech . . . Titanium ed., Jaffee et al.,Pergamon, NY, 1968, p. 677.

Heller et al., Journal of Less–Common Metals, 24, (1971), p. 265.

Van Noort, R., Journal of Mat. Sci., 22, (1987) p. 3801.

Hoar and Mears, "Corrosion–Resistant Alloys in Chloride Solutions: Materials for Surgical Implants", pp. 506–507.

Kirk–Othmer Encyclopedia of Chemical Technology, vol. 23, pp. 98–113.

Collins, "Physical Metallurgy of Titanium Alloys", American Society for Metals Series in Metal Processing.

*Primary Examiner*—Sam Silverberg
*Attorney, Agent, or Firm*—Shoemaker and Mattare

[57] ABSTRACT

Controllable oxidation of certain titanium zirconium alloys is achieved by utilizing minor proportions of niobium, tantalum or vanadium or mixtures thereof and articles formed therefrom can be partially oxidized to form a deep, hard monolithic oxide containing surface layer and further or completely oxidized to form a cermet or ceramic body respectively, which can be heated further to improve the ceramic bodies properties.

2 Claims, 16 Drawing Sheets

TERNARY OXIDATION DIAGRAM
FOR Ti-Zr-Nb ALLOYS AT 700°C

U.S. PATENT DOCUMENTS

| | | | |
|---|---|---|---|
| 3,677,795 | 7/1972 | Bokros | 117/46 |
| 3,752,664 | 8/1973 | Steinemann et al. | 75/134 |
| 3,777,346 | 12/1973 | Steinemann | 29/180 |
| 3,849,124 | 11/1974 | Villani | 75/177 |
| 3,911,783 | 10/1975 | Gapp et al. | 85/73 |
| 4,040,129 | 8/1977 | Steinemann et al. | 1/24 |
| 4,145,764 | 3/1979 | Suzuki et al. | 3/1.9 |
| 4,170,990 | 10/1979 | Baumgart et al. | 128/92 |
| 4,197,643 | 4/1980 | Burstone et al. | 7/58 |
| 4,511,411 | 4/1985 | Brunner et al. | 148/20.3 |
| 4,857,269 | 8/1989 | Wang et al. | 420/417 |
| 4,902,359 | 2/1990 | Takeuchi et al. . | |
| 5,372,660 | 12/1994 | Davidson et al. | 148/421 |
| 5,415,704 | 5/1995 | Davidson . | |

OXIDATION OF Ti RICH Ti-Zr-Nb ALLOYS AT 700°C

TERNARY OXIDATION DIAGRAM
FOR Ti-Zr-Nb ALLOYS AT 700°C

TERNARY OXIDATION DIAGRAM
FOR Ti-Zr-Nb ALLOYS AT 700°C

COMPOSITE ARTICLE, ALLOY AND METHOD

This application is a continuation-in-part of U.S. application Ser. No. 08/214,233, filed Mar. 17, 1994, by way of International Application No. PCT/US95/03314, with an International filing date of Mar. 17, 1995.

FIELD OF THE INVENTION

The present invention relates to the manufacture of ceramic layers on metal, shaped ceramic bodies, cermet articles, composite articles, and alloys used in such manufacture and more particularly to the field of reaction formed ceramics, articles made thereby, and alloys for use in their manufacture.

BACKGROUND OF THE INVENTION

Many of the alloys of titanium with zirconium or hafnium are characterized by their extraordinarily rapid oxidation in air at only modestly elevated temperatures. This characteristic has severely limited the usefulness of such alloys for many applications that could otherwise advantageously use the other physical properties of those alloys. In particular, the light weight, high strength and corrosion resistance of the alloys, as well as their electrical conductivity properties, biocompatibility, ease of closed-die forming and other desirable properties have not been fully exploited due to the potential ignition of the alloy in air at relatively low temperatures. Currently available processes for reducing the oxidation of these alloys during working have not completely solved the oxidation problem.

OBJECTS OF THE INVENTION

It is therefore an object of the present invention to provide utility to a class of titanium and zirconium alloys. It is a further object of the present invention to provide a method of fabricating a class of reaction formed ceramics directly formed from such alloys and articles produced thereby. It is yet a further object of the present invention to provide a method for forming adherent surfaces on such metal alloys which are hard, smooth, substantially inert and suitable for a wide variety of applications from cutlery to implantable prosthetic devices, and a method for renewing such monolithic surfaces.

SUMMARY OF THE INVENTION

Figure 1:
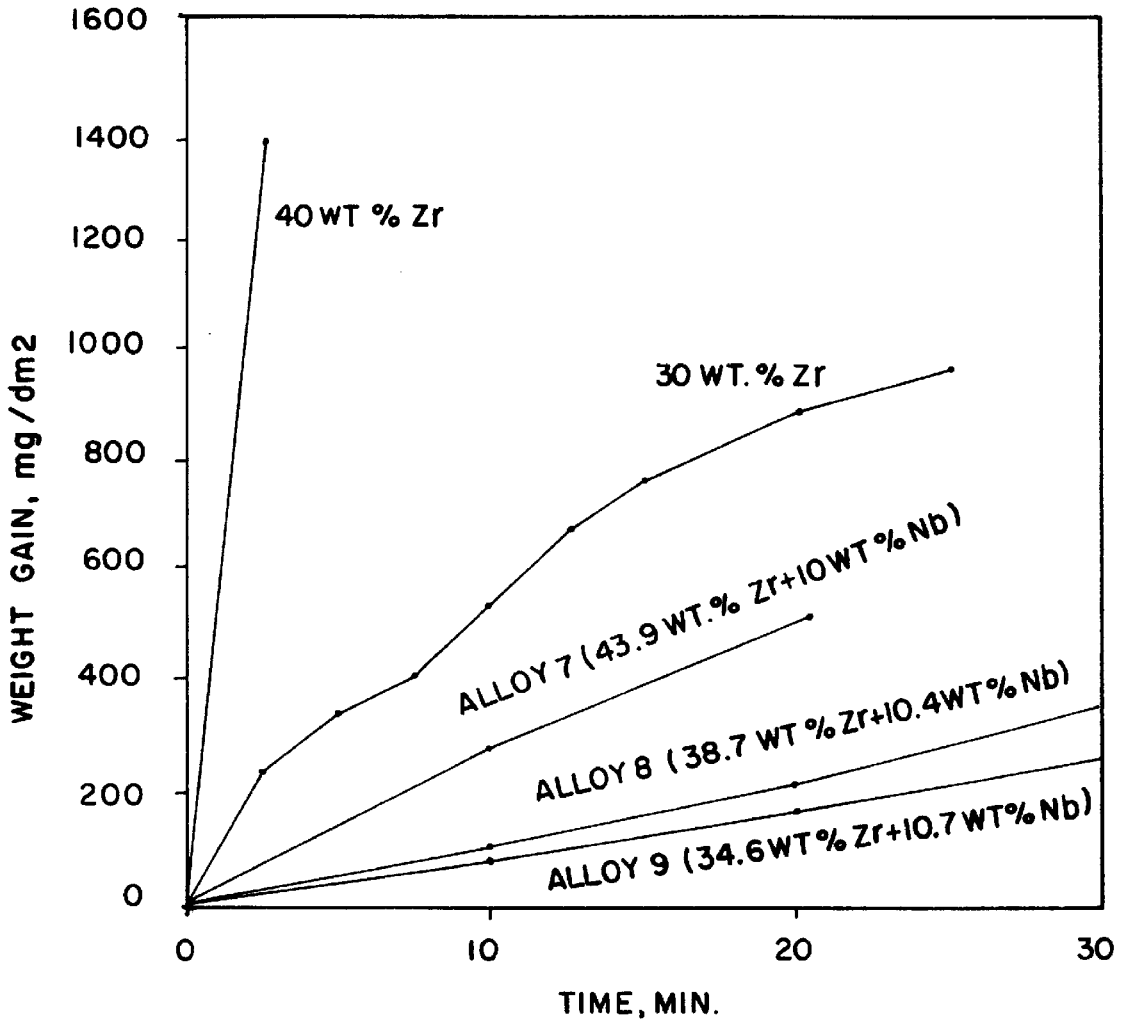
FIG. 1 is a graphical representation of some of the results reported in Table III of the weight gain of particular alloys at 700° C. as a function of time.

The inventors have discovered that ceramic bodies and a variety of ceramic surface layers formed in a metal body can be achieved by providing a substrate comprised of an alloy containing titanium, zirconium, and/or hafnium together with metals in minor amounts selected from the group consisting of niobium, tantalum and vanadium. The oxides of the metals can be obtained in situ by the controlled oxidation of the metal alloy substrate. Further, the present invention is particularly effective where the titanium and zirconium alloy is passivated against rapid oxidation by the presence of minor amounts of niobium or tantalum. Still further, oxides containing the metals of the metal alloys selected can be formed throughout the metal alloy structure by reaction with selected oxidants to form either a monolithic cermet or ceramic body or structure by the selection of appropriate oxidation conditions.

DETAILED DESCRIPTION OF THE INVENTION

As used in this specification and the appended claims, the terms below are defined as follows:

"Ceramic" is not to be construed as being limited to a ceramic material in the classical sense, that is, in the sense that it consists entirely of non-metallic and inorganic materials, but rather refers to a material which is predominantly ceramic with respect to either composition or dominant properties, although the material may contain minor or substantial amounts of one or more metallic constituents.

"Microporosity": Porosity in which pore diameters are of the order of 1–10 $\mu$m ("microns"), as opposed to "macroporosity" in which pores are considerably larger than 10 $\mu$m (microns).

"Oxidation reaction product" generally means one or more metals in an oxidized state wherein a metal has given up electrons to or shared electrons with another element, compound or combination thereof. Accordingly, an "oxidation reaction product" under this definition includes the product of the reaction of one or more metals with an oxidant, such as those described in this application.

"Oxidant" means one or more suitable electron acceptors or electron sharers which may be a solid, a liquid or a gas or some combination of these at the process conditions.

"Parent metal" is intended to refer to relatively pure metals, commercially available metals with impurities and/or alloying constituents therein, and alloys and intermetallic compounds of the metals. When a specific metal is mentioned, the metal identified should be read with this definition in mind unless indicated otherwise by the context.

A solid, liquid or vapor-phase oxidant, or a combination of such oxidants may be used, as noted hereinafter. For example, oxidants which may be emphasized include, without limitation, oxygen, nitrogen, ammonia, a halogen, sulphur, phosphorus, arsenic, carbon, boron, selenium, tellurium, and compounds and combinations thereof, for example, silica (as a source of oxygen), methane, ethane, propane, acetylene, ethylene, and propylene (as a source of carbon), and mixtures such as air, cracked ammonia, $N_2/H_2$, $H_2/CH_4$ and other hydrocarbons $H_2/H_2O$ and $CO/CO_2$, the latter two (i.e. $H_2/H_2O$ and $CO/CO_2$) being useful in reducing the oxygen activity of the environment.

A vapor-phase (gas) oxidant is preferred, and specific embodiments of the invention are described herein with reference to the use of vapor-phase oxidants. If a gas or vapor oxidant is used, the term "vapor-phase oxidant" means a vaporized or normally gaseous material which provides an oxidizing atmosphere. For example, oxygen or gas mixtures containing oxygen, including air, are preferred for obvious reasons of economy. When an oxidant is identified as containing or comprising a particular gas or vapor, this means an oxidant in which the identified gas or vapor is the sole oxidizer of the parent metal at certain conditions under the conditions employed in the oxidizing environment utilized. For example, although the major constituent of air is nitrogen, the oxygen content of air is the oxidizer for the parent metal because oxygen is a significantly stronger oxidant than nitrogen. Air therefore falls within the definition of an "oxygen-containing gas" oxidant but not normally within the definition of a "nitrogen-containing gas" oxidant.

In its preferred practice, the present invention will be described hereinafter with respect to alloys of titanium, zirconium or hafnium, or mixtures of the latter to which have been added minor amounts of other specific metals in sufficient quantity to render the overall alloy more resistant to rapid, combustion-like, oxidation at the temperatures described than the alloy would have been without the metal addition. It should be appreciated that wide composition limits are possible in the practice of the present invention when oxidation conditions are sufficiently controlled in any manner so as to prevent rapid reaction. For example, uncontrolled oxidation can be prevented where an inert gas diluent or reducing gas diluent is employed in an adequately sufficient amount to prevent uncontrolled oxidation, or where the surface of the alloy is protected against unmoderated exposure to high concentrations of a gaseous oxidant. To obtain particularly advantageous metallurgical properties, however, it may be necessary to conduct the oxidation reaction at ambient pressures in air at elevated temperatures i.e., where combustion would normally occur. It is, therefore, necessary to passivate the alloy of titanium, containing zirconium or hafnium, or mixture thereof, with minor amounts of a passivating metal or metal alloy, selected from the group consisting of niobium, tantalum or vanadium or mixture thereof. The foregoing passivation is also contemplated where over-pressures of oxygen are employed and where the Ti alloy has been passivated with niobium, tantalum or vanadium.

As will be more fully described hereinafter, the titanium alloys described herein and the process of their conversion into oxides or oxidation reaction products can be regulated to produce a type of cermet or ceramic product which product differs radically from prior attempts to provide inert wear resistant surfaces or cermet or ceramic bodies by either the bonding of inorganic ceramic-like material to the surface of a metal or by surface passivation reactions with molten salts or the like; or by the reaction formation of a ceramic body by the oxidation of a molten metal either alone or by infiltrating a preform matrix with an oxidizable metal and forming the ceramic in situ.

Typically, a rapid combustion-like reaction in air of some of the alloys described herein will produce a loose powder containing the single or mixed oxides of the parent metal and the alloy constituents. Such a result is, of course, unsatisfactory for the production of ceramic articles without further ceramic fabrication processing steps. The controlled oxidation of the present invention directly produces unitary, monolithic adherent structural layers of nearly any preselected depth or thickness or rigid ceramic or cermet bodies. The processes of the present invention are suitable for the formation of shaped ceramic articles, ceramic-metal composites and for the formation of smooth-hard impact resistant ceramic surfaces on metal articles. It is contemplated that the oxidizable metal can be bonded to other metal or ceramic substrates and then subsequently have its exposed surface contacted with an oxidant to form a ceramic layer of any preselected depth or thickness or a completely oxidized ceramic outer layer on the selected substrate. Likewise, it is contemplated that reinforced composite ceramics can be produced by incorporating reinforcing materials or precursors to reinforcing materials into the metal prior to the oxidation conversion to a reinforced ceramic article. The present invention also contemplates the use of the alloys described as reinforcements in other ceramic articles which can be converted at high temperatures to the ceramic articles described herein in another ceramic body.

The present invention in its preferred practice forms oxide layers on the surface of the passivated alloys described, in air or other suitable oxidant-containing gas at temperatures of from about 300° C. to 800° C. and most preferably from about 500° C. to about 800° C. which layers are adherent, monolithic, hard, smooth, wear resistant surface layers of any desired depth depending on the temperature and time chosen. Typically 2 microns to 50, or more, micron layers can be easily formed. Moreover, since intricate shapes can be fabricated from the preferred metal alloy, the complete conversion of the alloy to oxides or mixed oxides can be controllably managed, preferably at temperatures of about 800° C. to about 1500° C. and for a sufficient period of time to produce shaped ceramic articles which have been substantially completely oxidized and typically contains uniformly distributed micro-porosity which may vary in pore size when the oxidation process is conducted at different temperatures on the same starting material.

Due to the moderation of the rate of oxidation imparted by the processes and compositions described herein, relatively thick oxide layers can be obtained on the parent metal or metal alloy at moderate temperatures and within relatively short times. This is shown most clearly in FIGS. 6–8. It is therefore now feasible to provide a hard surface on the parent metal while retaining the strength or toughness of the underlying metal substrate. For example, surface oxide thicknesses of 2.5 to 25 $\mu$m can impart a hardness of approximately $R_c$ 70 to the cutting edge of a cutlery implement made from a titanium alloy comprising 35 wt. % zirconium and 10 wt. % niobium with the balance being titanium, by heating the implement in air at between about 300° C. to about 800° C. for a sufficient period of time to achieve the described hard, smooth oxide or ceramic layer. The process can even be repeated on a worn implement where a new hardened surface is desired using such readily available equipment as a conventional self-cleaning oven which is capable of reaching temperatures of about 450° C.

The utility of the present invention is further enhanced for many end use applications due to the excellent fabricability of the described titanium alloys. A wide range of mechanical properties is obtainable. Normally a titanium alloy containing 35 wt. % zirconium and 10 wt. % niobium exhibits a yield strength of only 2,000–3,000 psi at 1,350° F. (with 200% elongation). Such an alloy can however be solution-treated, quenched and aged to obtain a room temperature yield strength of 140,000 psi. The alloy can be closed-die-forged to obtain articles of complex shape which can subsequently be surface hardened by the controlled oxidation process described herein while retaining some of the mechanical properties imparted by the foregoing mill practice. The article can, as described herein, be completely oxidized to produce a monolithic ceramic body. Near net shape ceramic articles can be produced by oxidizing the metal alloy preform which exhibit elastic modulus and other properties which are comparable to human bone. Likewise, it is possible to investment cast the alloy to achieve the desired shape and subsequently oxidize the shaped article in a partial or complete manner as described. In this manner, cutlery implements, dental castings, orthopedic prosthetic devices and the like can be fabricated. Small parts requiring great wear resistance, such as is necessary in certain firearms mechanisms can particularly benefit from the practice of this invention.

An unexpected benefit is obtained by the practice of the present invention when making medical devices that in use are designed to bear against a plastic element, such as ultra high molecular weight polyethylene. The surface of the shaped article, after the controlled oxidation described herein to produce a smooth surface layer, is smooth enough to reduce attrition of the plastic or fretting of the plastic into small particles which is an undesirable phenomenon in some orthopedic prosthesis implants. This advantage combined with the excellent biocompatibility of titanium-zirconium alloys and the possibility of forming materials having a generally low modulus of elasticity makes the articles formed as described highly desirable for such medical devices and in particular prosthetic devices. A low modulus better matches materials of relatively low stiffness such as mammalian bone. Likewise, the volume change upon conversion to a ceramic are acceptable for most applications and the problems normally encountered with mismatches in the coefficients of expansion are minimal. Undue experimentation is not believed to be necessary to optimize the desired properties by adjusting alloy composition and preparation.

Understanding the reasons for the formation of the articles described herein from the alloys described is incomplete at the present time. It is postulated that the advantageous properties achieved, according to the practice of the present invention are achieved by the relatively rapid transport of dissolved oxygen into the binary alloy of titanium and zirconium by its solution into a phrase rich in the third alloying metal constituent which is present at the grain boundaries of the binary alloy constituents. Such a mechanism would help to explain why the ceramic layer obtained at relatively low temperatures remains monolithic and adherent rather than forming oxides simply as a surface phenomenon as previously done, which could produce scales which are easily dislodged if the oxidation were performed as described herein. Alloying materials which have high oxidizing agent transport properties should then be suitable for use in the practice of the present invention. In the practice of the present invention it has been discovered niobium, tantalum and vanadium provide both passivation of the ignition characteristics of the Ti—Zr binary alloy and may provide the postulated dissolved oxygen transport for ceramic formation.

The following discussion is intended to advance further understandings of the invention while not being bound to any particular theory.

While the extensive work of W. Wyder and M. Hoch (The System Niobium-Titanium-Zirconium-Oxygen at 1500° C. *Trans. Metallura. Soc.*, AIME, Vol. 224, pp. 373–378, 1962) in constructing the Nb—Ti—Zr phase diagrams representing oxygen levels of 10, 20, 30, 40, 50 and 55 atomic % is recognized as a classical accomplishment, the fact that it represents only the isotherm at 1500° C. limits its utility in studying oxidation at the lower temperatures employed in the practice of the present invention.

A more relevant phase diagram is that of the Zr—Ti—Nb system at 570° C. published in 1968 by F. Ishida, (Ishida, F., T. Doi and M. K. Tada *Nippon Kinzoku* Gakkaishi, Vol. 32, No. 7, pp. 684–685, 1968) although one must always bear in mind the effects of oxygen on the system which may be estimated from the metal-oxygen binary phase diagrams.

The inventors herein have determined experimentally the boundary in the TiZrNb ternary system which separates alloys into "passive" and "ignitable" categories. The boundaries are shown in ternary phase diagrams expressed in terms of a scale of percentage amounts on an atomic basis. Although it is conventional to refer to the alloys on a weight basis in commercial sales literature, when constructing a ternary composition diagram it is more convenient to express the exchange of different components on a uniform atomic basis rather than on weight basis. Lines on a weight basis scale can vary considerably for small atomic changes due to the different molecular or atomic weights of the materials involved.

When reading the ternary diagrams which are in atomic % the percentage of an element is determined by starting at the base of the triangle which is taken as 0% and reading toward the apex labelled with that element which is taken as 100%. For each alloy, which is a point in the diagram, a calculation must be made to convert that atomic % to weight %. The calculation involves taking the product of the selected element's atomic weight and its atomic percentage and dividing by the sum of these products for all three elements. For example, the point in the exact center of the diagram is 33⅓ atomic % of each element. To convert this point to weight % for Nb, Zr and Ti the calculations are:

$$\text{wt \% Nb} = \frac{(33.33)(92.9)}{(33.33)(47.) + (33.33)(91.2) + (33.33)(92.9)} = 40.04\%$$

$$\text{wt \% Ti} = \frac{(33.33)(47.9)}{\text{same denominator}} = 20.65\%$$

$$\text{wt \% Zr} = \frac{(33.33)(91.2)}{\text{same denominator}} = 39.31\%$$

To convert the weight % into atomic % the procedure is to divide the quotient of the wt % divided by the atomic weight of an element by the sum of the quotients of all three elements. For example, the alloy Ti-13Zr-13Nb (wt %) is converted to atomic % as follows:

$$\text{at \% Nb} = \frac{13/92.9}{74/47.9 + 13/91.2 + 13/92.9} = 7.66\%$$

$$\text{at \% Zr} = \frac{13/91.2}{\text{same denominator}} = 7.80\%$$

$$\text{at \% Ti} = \frac{74/47.9}{\text{same denominator}} = 84.54\%$$

Figure 21:
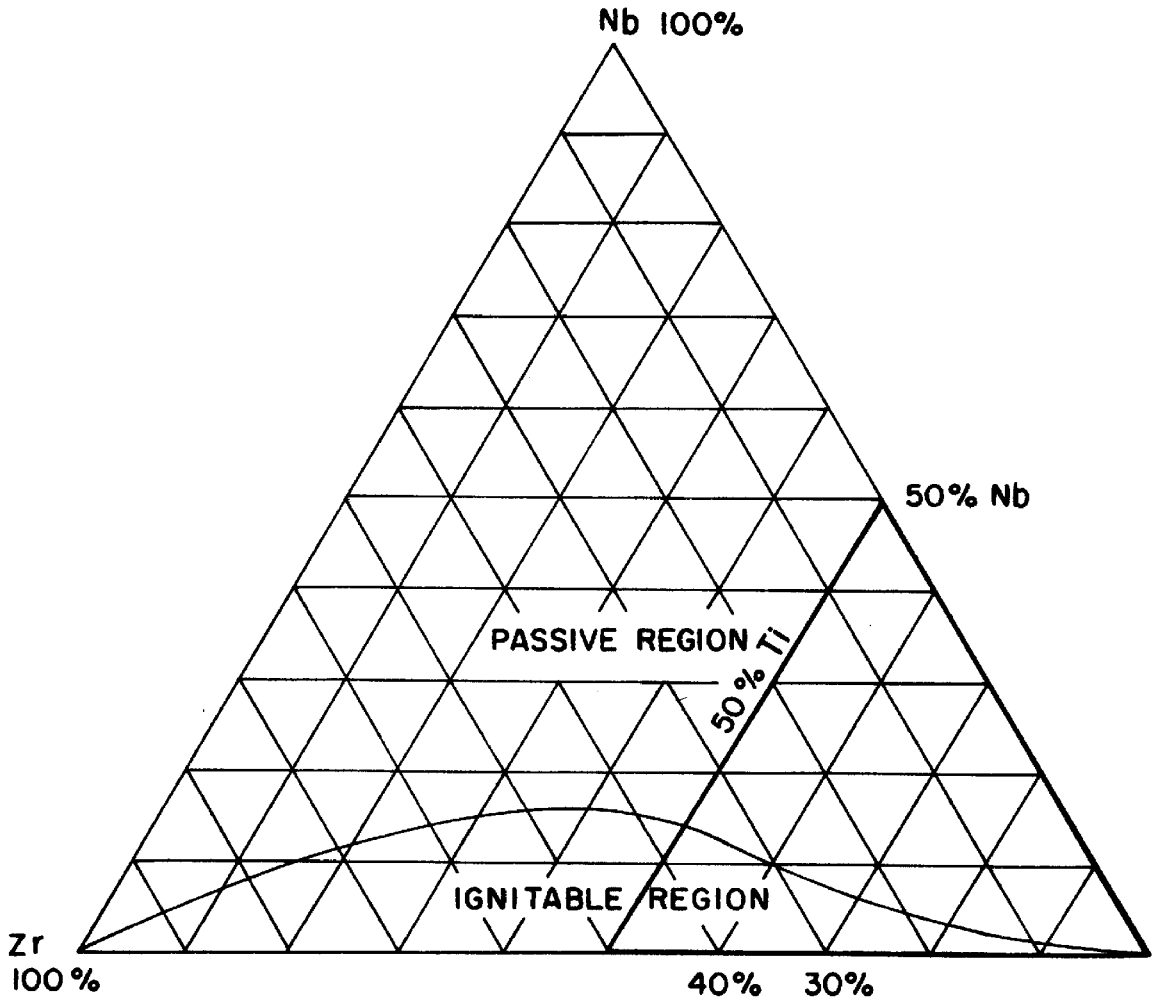
FIG. 21 is a ternary oxidation diagram for all alloys of Ti, Zr and Nb showing in atomic percent the entire passivation range produced by Nb additions.
Figure 22:
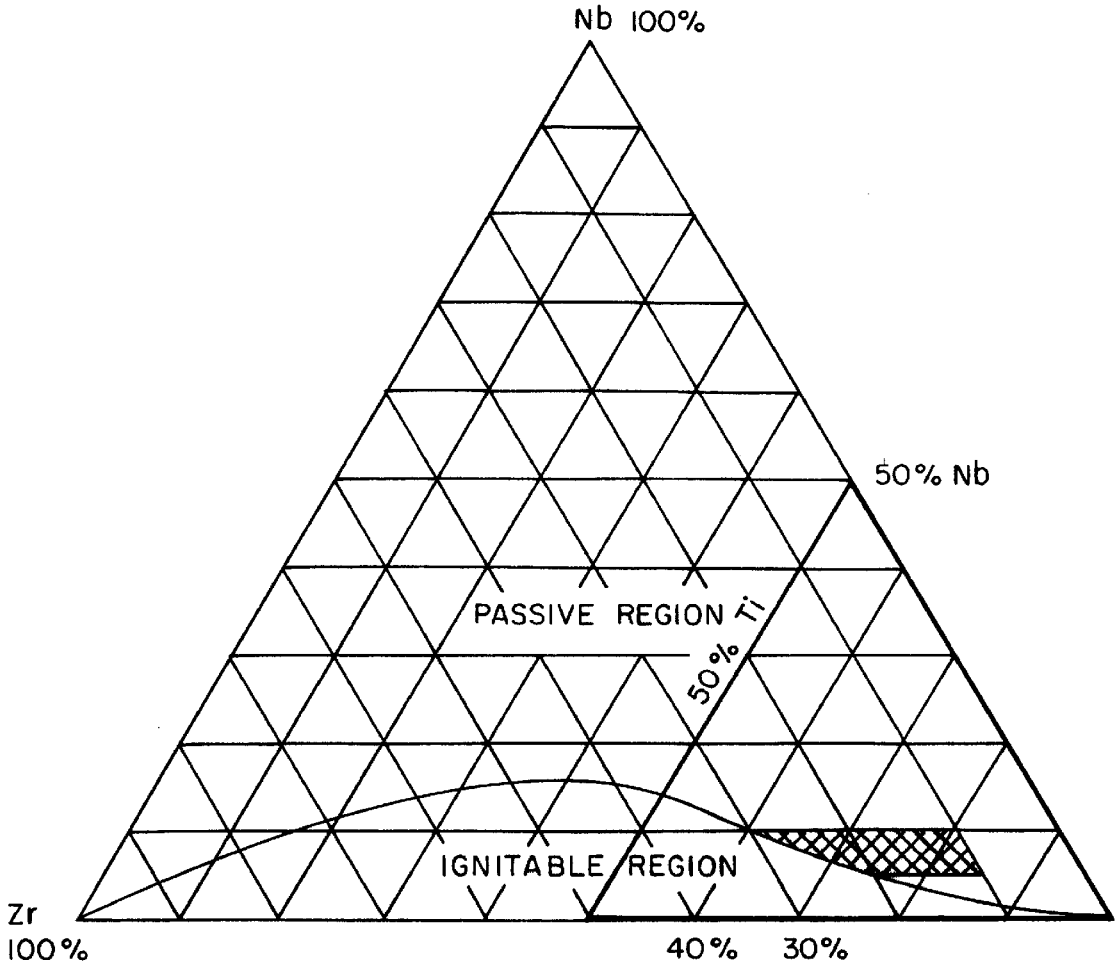
FIG. 22 is a ternary oxidation diagram showing in atomic percentages the passivation range of titanium rich, zirconium alloys passivated by the addition of various amount of niobium.

The Ternary Oxidation diagram for Ti—Zr—Nb Alloys at 700° C. with the ignitable and passive regions identified is shown in FIG. 21. The titanium rich portion of that diagram is shown in larger scale in FIG. 4. FIG. 22 is another diagram of the titanium rich portion. The area in cross hatch labelled A represents the preferred passivated compositions of the present invention. These compositions consists of at least an area defined by (a) a parallelogram having the corner points in atomic percent of
70Ti-20Zr-10Nb
80Ti-10Zr-10Nb
85Ti-10Zr-5Nb and
75Ti-20Zr-5Nb; and (b) an adjacent triangle having the corner points in atomic percent of
70Ti-20Zr-10Nb
75Ti-20Zr-5Nb and
60Ti-30Zr-10Nb.

Figure 2:
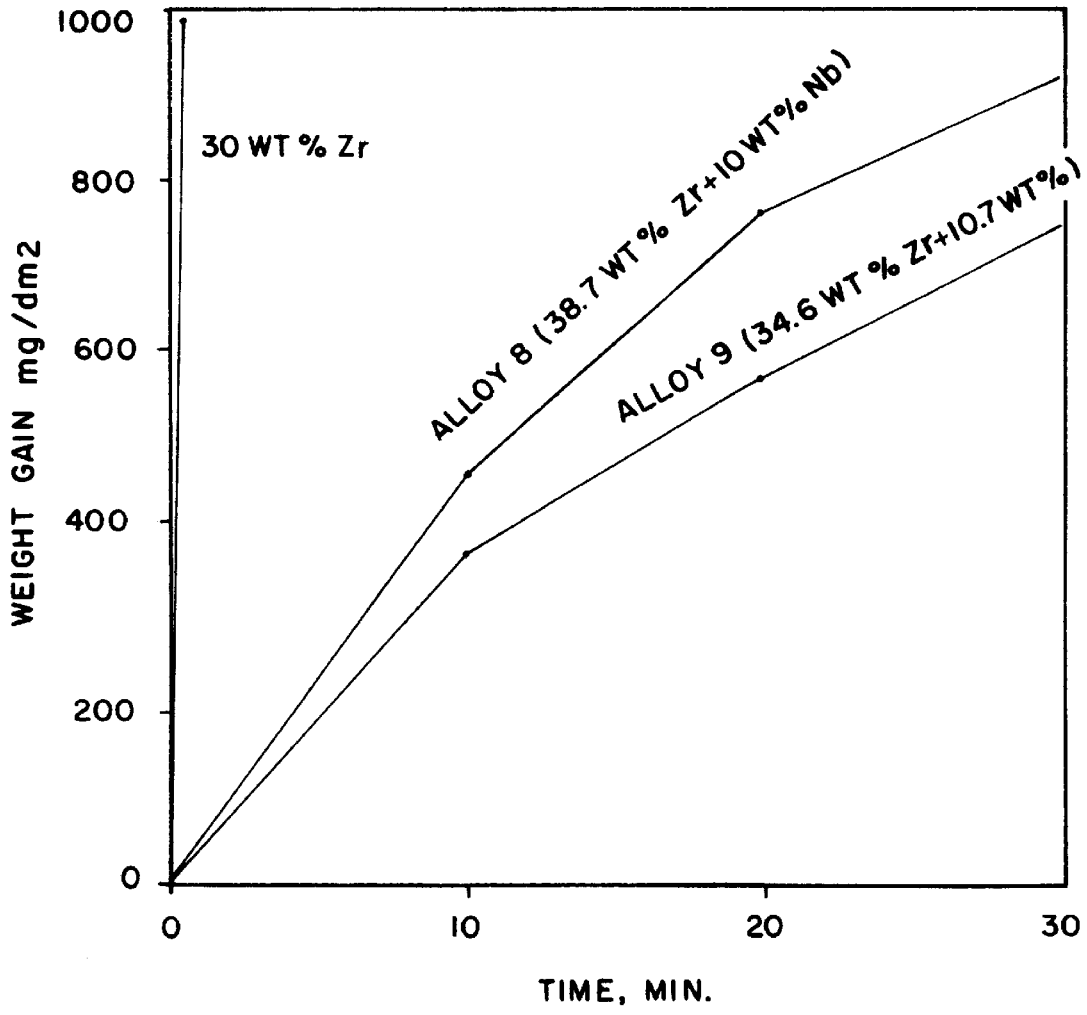
FIG. 2 is a graphical representation of some of the results reported in Table III of the weight gain of particular alloys at 800° C. as a function of time.
Figure 3:
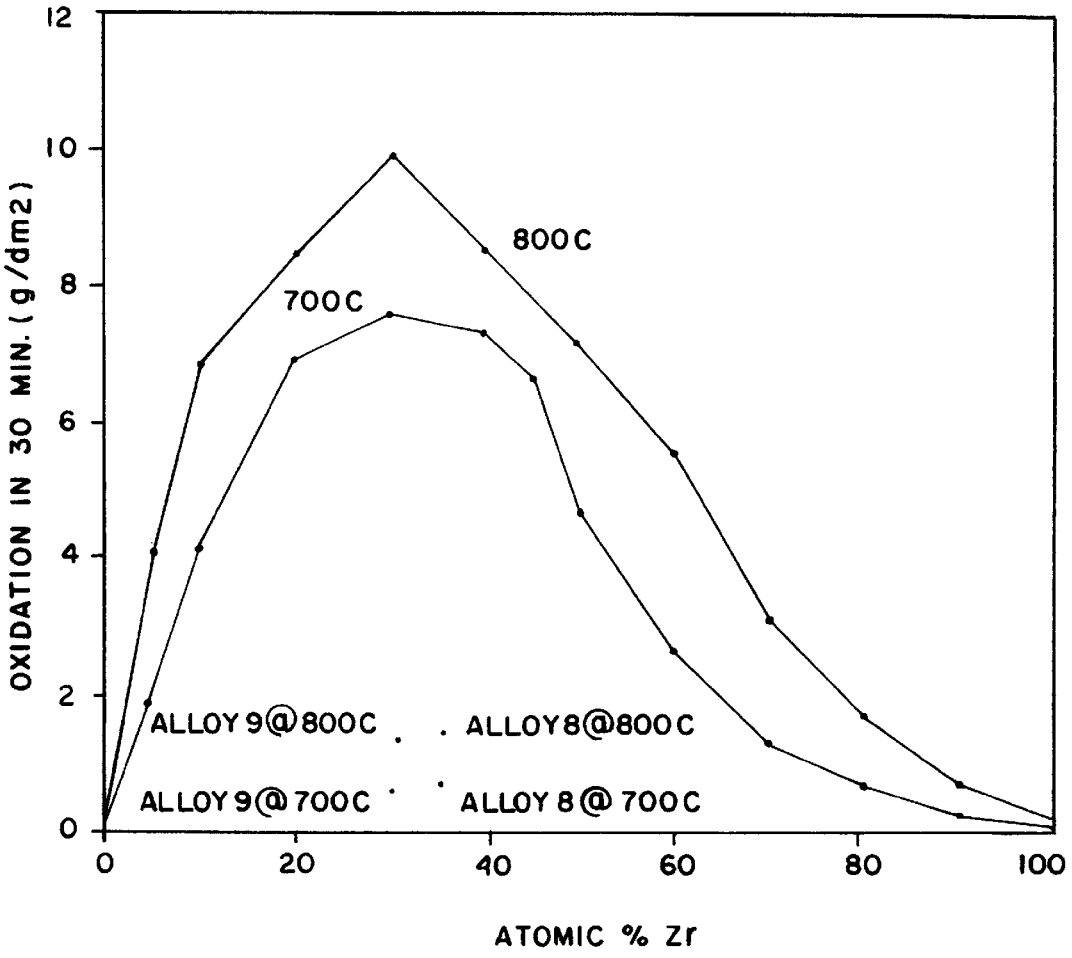
FIG. 3 is a graphical representation of the effect on the oxidation rate for Ti—Zr alloys of the addition of various amounts of niobium.

The weight gain shown graphically for Alloys 7, 8, and 9 in FIG. 1 and Alloys 8 and 9 in FIGS. 2 and 3 can be related to the data contained herein. In attempting to account for the differences between various TiZrNb alloys, it was observed that transformations in the metallic phases were not necessarily indicative of the observed differences in oxidation behavior. This observation, coupled with the realization that all such alloys owe their oxidation resistance to protective oxide surface films, could lead one to conclude that studies of the oxide phases are more appropriate toward understanding oxidation behavior. The works of Kofstad, P. *High Temperature Oxidation of Metals*, John Wiley and Sons, Inc., New York, 1966, and others present methods of identifying various mechanisms of oxidation based upon determining characteristic shapes of oxidation rate curves. An example of this approach is that of the oxidation kinetics of titanium at various temperatures. Referring to the general equation $w^n$=kt (where w=weight gain per unit area, t=time, k=a constant), oxidation occurs at the following rates within indicated temperature regimes:

I: 100°–400° C.: logarithmic

II: 400°–600° C.: transition (log-parabolic or cubic)

III: 600°–1000° C.: parabolic

IV: 1000°–1100° C.: linear

Phase I is dominated by oxide film formation, II by oxygen dissolution in which cubic-versus-parabolic behavior is determined by pre-existing oxygen gradients in the metal, III by a combination of oxygen dissolution and scale formation, and IV by loss of protective behavior.

In addition to reviewing empirical studies of oxidation kinetics, it is important to appreciate the large number of phases which may be observed in oxidation products of TiZrNb alloys. Although Zr in oxides is nearly always tetravalent, three allotropic forms of $ZrO_2$ are observed: monoclinic (at ≦949° C.), tetragonal (949°–1221° C.), and cubic (>1221° C.)[30]. Titanium presents a much more extensive spectrum of oxides:

| Oxide | Structure |
|---|---|
| α-TiO | monoclinic |
| β-TiO | cubic |
| $Ti_2O_3$ | hexagonal |
| $Ti_3O_5$ | monoclinic |
| $TiO_2$ (anatase) | tetragonal |
| $TiO_2$ (rutile) | orthorhombic |
| $TiO_2$ (brookite) | hexagonal |

Niobium oxides are nearly as diverse as those of titanium:

| Oxide | Structure |
|---|---|
| NbO | cubic |
| $Nb_2O_3$ | |
| $NbO_2$ | tetragonal |
| $Nb_2O_5$ | orthorhomic |

Figure 5:
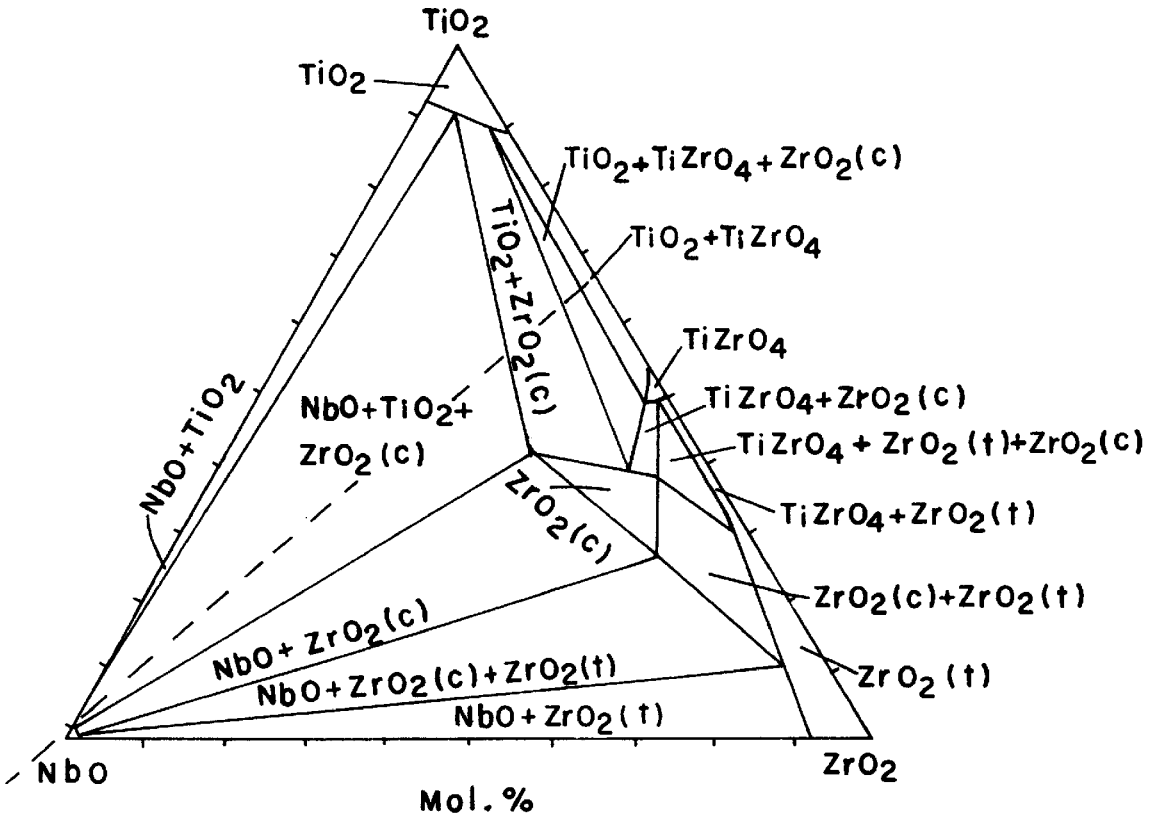
FIG. 5 is a phase diagram at 1500° C. of mixed titanium, zirconium and niobium oxides published by Levin, E. and H. McMurdie, Phase Diagrams for Ceramists, 1975 Supplement, p. 169 American Ceramic Society.

In understanding the possible phases which may be observed in TiZrNb oxidation products, one must not only consider the single oxides of each metal, but much more complex compounds formed in the quaternary system Ti—Zr—Nb—O shown in FIG. 5. (and more with description).

Figure 23:
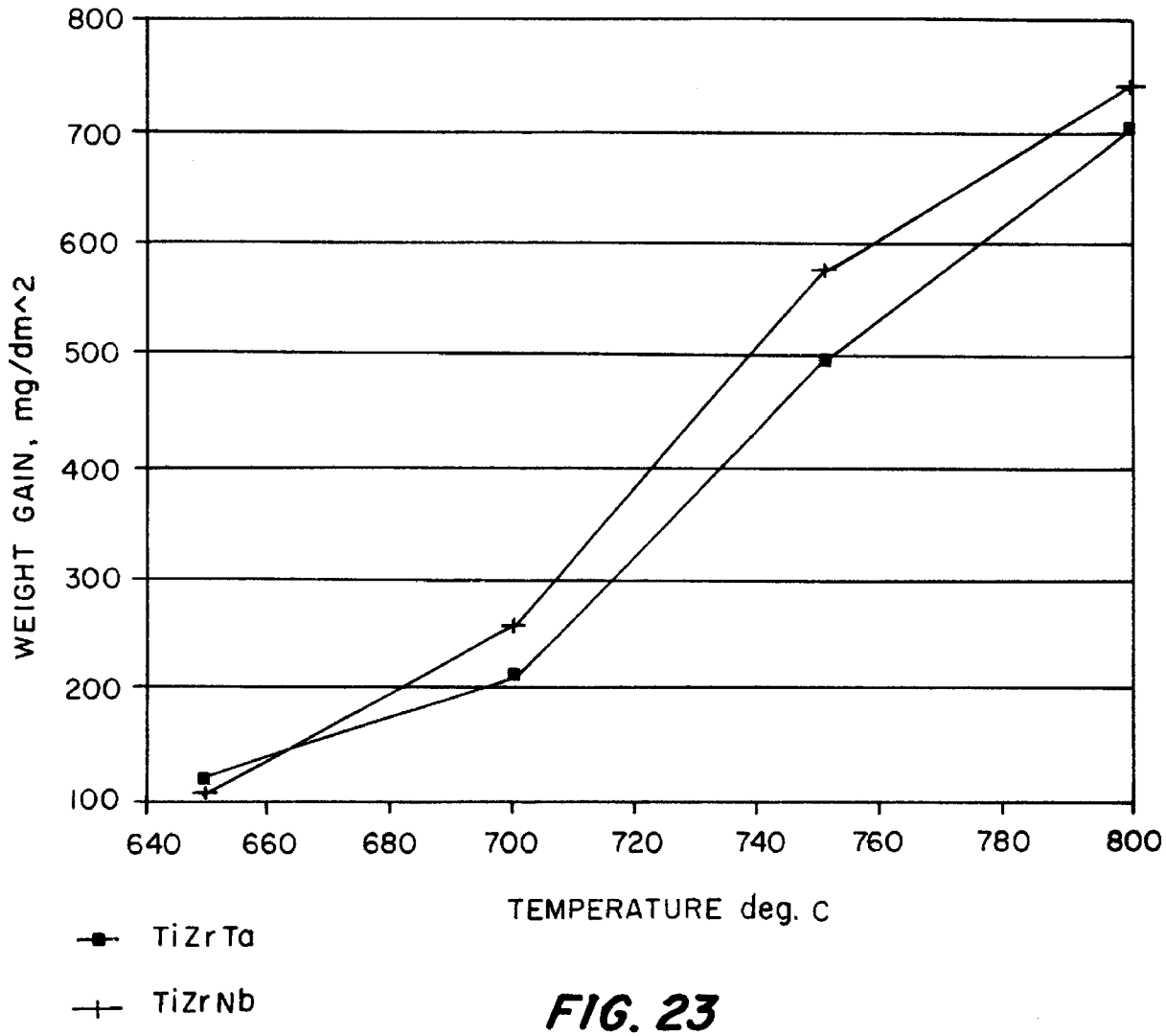
FIG. 23 is a graphical representation of the weight gain for alloys containing TiZrTa and TiZrNb alloys as a function of temperature.

The following examples further describe the processes, compositions, and products encompassed within the scope of the present invention. In the examples it is demonstrated that under certain conditions the binary alloy of titanium and zirconium is passivated from undergoing combustion-like oxidation by the addition of niobium or tantalum, or vanadium (or mixtures thereof) in modest amounts. See, for example, FIG. 23 where tantalum is substituted for niobium and it produces a similar weight gain.

EXAMPLE 1

A. Oxidation of TiZrNb Alloys at 600°–800° C.

Twenty vacuum-arc-melted alloy buttons (Table I) representing five different Nb concentrations (3.5, 5.7, 7.0, 10.5 and 14 at. %) at various Zr:Ti atomic ratios (2:1–1:3) were prepared for thermogravimetric studies of oxidation rate. Duplicate buttons were prepared and studied for five of the 15 different compositions.

TABLE I

| Alloy No. | Zr:Ti At. Ratio | Chemical Composition — Calculated Values — Atomic % Zr | Ti | Nb | Weight % Zr | Ti | Nb | Actual Analysis Weight % Zr | Ti | Nb |
|---|---|---|---|---|---|---|---|---|---|---|
| 1 | 2:1 | 64.5 | 32 | 3.5 | 78 | 17.7 | 4.3 | 77.3 | 18.5 | 4.26 |
| 2A | 1:1 | 48.3 | 48.2 | 3.5 | 62.6 | 32.8 | 4.6 | 62.8 | 32.8 | 4.35 |
| 2B | 1:1 | 48.3 | 48.2 | 3.5 | 62.6 | 32.8 | 4.6 | 62.6 | 33.0 | 4.43 |
| 3 | 1:2 | 32 | 64.5 | 3.5 | 46.1 | 48.8 | 5.1 | 46.4 | 48.7 | 4.90 |
| 4 | 2:1 | 62 | 31 | 7 | 72.6 | 19.1 | 8.3 | 72.7 | 19.6 | 7.76 |
| 5 | 1:1 | 46.5 | 46.5 | 7 | 59.6 | 31.3 | 9.1 | 59.6 | 31.5 | 8.86 |
| 6 | 1:1.5 | 37 | 56 | 7 | 50.3 | 40 | 9.7 | 50.6 | 40.3 | 9.15 |
| 7 | 1:2 | 31 | 62 | 7 | 43.9 | 46.1 | 10.0 | 43.6 | 47.0 | 9.42 |
| 8 | 1:2.5 | 26.5 | 66.5 | 7 | 38.7 | 50.9 | 10.4 | 37.3 | 52.9 | 9.77 |
| 9 | 1:3 | 23.2 | 69.8 | 7 | 34.6 | 54.7 | 10.7 | 34.8 | 55.1 | 10.1 |
| 10A | 2:1 | 59.7 | 29.8 | 10.5 | 69.4 | 18.2 | 12.4 | 69.7 | 18.8 | 11.4 |
| 10B | 2:1 | 59.7 | 29.8 | 10.5 | 69.4 | 18.2 | 12.4 | 69.8 | 18.8 | 11.5 |
| 11 | 1:1 | 44.8 | 44.7 | 10.5 | 56.7 | 29.7 | 13.6 | 57.4 | 30.1 | 12.5 |
| 12A | 1:2 | 29.8 | 59.7 | 10.5 | 41.5 | 43.6 | 14.9 | 42.6 | 43.4 | 14.0 |
| 12B | 1:2 | 29.8 | 59.7 | 10.5 | 41.5 | 43.6 | 14.9 | 42.5 | 43.5 | 14.0 |
| 13 | 1:1 | 43 | 43 | 14 | 53.9 | 28.3 | 17.8 | 54.7 | 28.7 | 16.6 |
| 14A | 2:1 | 64.5 | 29.8 | 5.7 | 75 | 18.2 | 6.8 | 75.4 | 18.2 | 6.39 |
| 14B | 2:1 | 64.5 | 29.8 | 5.7 | 75 | 18.2 | 6.8 | 74.7 | 19.0 | 6.36 |
| 15A | 1:2 | 29.8 | 64.5 | 5.7 | 42.9 | 48.8 | 8.3 | 44.2 | 47.9 | 7.89 |
| 15B | 1:2 | 29.8 | 64.5 | 5.7 | 42.9 | 48.8 | 8.3 | 44.2 | 48.6 | 8.19 |

For thermogravimetric evaluation, 400-g buttons of each alloy were sectioned and machined to yield specimens of approximately 10×18×18 mm. All buttons were given a vacuum heat treatment for one hour at 1500° C. and furnace-cooled to ensure alloy homogeneity. Each specimen was weighed to the nearest 0.1 mg and measured dimensionally to determine total surface area. Oxidation was effected by placing sets comprised of specimens of each alloy in an electric resistance furnace (air atmosphere) for times of 10, 20, and 30 minutes at temperatures of 600°, 650°, 700°, 750° and 800° C., respectively.

Visual observations of the specimens were made at approximately five-minute intervals in order to determine more accurate ignition times at particular furnace temperatures. Ignition was indicated by visible sparking and a distinct color change as the specimen temperature rapidly exceeded furnace temperature. During oxidation, samples were placed in random locations on a metal plate which rested on the bottom of the furnace and whose temperature was monitored by a thermocouple. Specimens were placed into 25 ml fireclay crucibles in order to contain spalling oxidation product which might otherwise contaminate neighboring specimens. Included in each furnace cycle were coupons (1.5×25×50 mm) of pure Zr, Hf, Ti, and Nb, which served as standards with known oxidation kinetics. Following oxidation, weight-gain values were determined in units of $mg/dm^2$, in accordance with customary corrosion rating convention.

In an effort to obtain more data points by which to establish a boundary in the TiZrNb ternary system separating "passive" from "ignitable" alloys, six additional compositions were cast (Table II).

TABLE II

| Alloy No. | Zr:Ti | Additional Alloys — Atomic % Zr | Ti | Nb | Weight % Zr | Ti | Nb |
|---|---|---|---|---|---|---|---|
| 16 | 1:5.44 | 14.8 | 80.5 | 4.7 | 23.9 | 68.3 | 7.8 |
| 17 | 1:5.45 | 14.3 | 77.9 | 7.8 | 22.7 | 64.8 | 12.5 |
| 18 | 1:3.62 | 19.6 | 71.0 | 9.4 | 29.5 | 56.1 | 14.4 |
| 19 | 1:1.86 | 31.2 | 58.0 | 10.8 | 42.5 | 41.5 | 15.0 |
| 20 | 1.18:1 | 47.8 | 40.6 | 11.6 | 53.1 | 23.7 | 13.2 |
| 21 | 1.38:1 | 54.0 | 39.1 | 6.9 | 66.2 | 25.2 | 8.6 |

Specimens of these compositions were tested only for ignitability at 650°, 700°, and 800° C. No time-dependent weight gain data were taken for these specimens.

B. Oxidation of TiZrNb Alloys at 1200°–500° C.

Additional specimens of the experimental alloys were oxidized in air for 1.0 hr at 1200° C. This treatment was sufficient to obtain heavy oxide layers on even the most passive alloys. The oxides were evaluated by X-ray diffraction, metallography, and electron microprobe.

C. Evaluation of a Ti35Zr10Nb (wt. %) Developmental Ingot

A triple-melted, 4-inch-diameter (101.6 mm) version of Alloy No. 9 (Table I) was produced from Ti sponge, Zr sponge and Nb46Ti (wt. %) turnings by conventional consumable electrode vacuum arc melting methods. This alloy, had a chemical composition of 54.7Ti34.6Zr10.7Nb (wt. %), equivalent to 69.8Ti23.2Zr7Nb (atomic %). After removal of the shrink pipe and minor sidewall machining, the ingot measured 3.95" dia.×6.5" long and weighed 15.3 lb (100.3 mm×165.1-mm, 6.94 Kg). Forging at 800° C. was performed in accordance with the following schedule:

1) Upset 6.5" dimension to 4.5".

2) Square to 4" tk×6" wide.

3) Reheat 15 minutes at 800° C.

4) Reduce tk to 2".

5) Reheat 15 minutes at 800° C.

6) Finish to 1.375×5"×L.

Samples were cut from top and bottom of the slab for chemical analyses.

The forging was hot rolled at 800° C. (17% reduction per pass) without reheating to 0.510" (12.95 mm) thick and cut in half. Following descaling and chemical cleaning ($HF/HNO_3$), a portion of the plate was again heated to 800° C. and rerolled to 0.260" (6.6 mm), again using 17% reductions without reheating. Samples representing the rolled condition were annealed for 1.0 hr at 800° C. the remainder of the material was then solution-treated for 60 minutes at 850° C., followed by water quenching. The quenched plate was then sheared into specimens for precipitation hardening studies at 500° C. for times of 15, 30, 60, 120 and 180 minutes. Specimens representing the asquenched and 120-minute aged conditions were submitted for tensile testing.

Young's modulus was determined for specimens of the as-rolled, as-quenched and variously-aged conditions. These measurements were obtained by a dynamic "impulse response analysis" (IRA) method. In this method, a specimen is supported in such a way as to allow free vibrational motion when a mechanical impulse is applied to it. The IRA instrument and accompanying software analyze the vibrational characteristics of the specimen and calculate elastic modulus. Although the method is capable of determining both flexural and torsional moduli, from which Poisson's ratio may be calculated, only flexural moduli were determined in the present studies. This method allows the same specimen to be non-destructively evaluated after various heat treatment operations in an expedient manner.

Additional samples of ¼" and ½" plate were oxidized under various conditions of temperature (500°–1500° C.) and time (1–40 hours). Metallographic and SEM evaluations of the oxides were performed.

Preliminary evaluations were conducted by machining cutting edges on a knife blank prepared from both as-quenched and precipitation-hardened plate, followed by various surface oxidation treatments in an attempt to determine the alloy's potential as a cutting implement. The knife blank was prepared by machining, heat treating and finishing of an existent knife blade design. This demonstration blade was produced using the following specific process:

1) Solution-treat ¼" plate for 60 min. at 850° C., water quench.

2) Precipitation harden for two hrs. at 500° C., air cool.

3) Descale, chemically clean.

4) Machine blade profile to uniform 0.160" thickness.

5) Grind contours and edge

6) Oxidize for 90 min. at 650° C. to a blue-black color.

7) Assemble into finished knife. This knife was tested in a qualitative manner by many cycles of cutting various materials, resharpening and refinishing, the latter being accomplished by a variety of methods, including heating to up to about 500° C. for one to two hours in a self-cleaning oven home appliance. This latter treatment being used to duplicate instructions given to a consumer when resharpening and rereacting a knife blade of this type at home.

D. Evaluation of Larger Ingot of the Alloy

A 9.0"-dia. (229 mm) ingot of approximately 110 lb was produced by triple vacuum-arc-melting in an analogous manner to that used for the previous 4"-dia. developmental casting. Forging to 2"×11" cross section was performed at 850° C., followed by annealing for 30 min. at 815° C. Hot rolling to thicknesses of 0.310" (7.9 mm), 0.270" (6.85 mm) and 0.180" (4.6 mm) was accomplished at 800° C., with 17% reductions per pass. These sizes were produced for experimental production of two different types of knife blades and a forged version of plier jaws. In addition to these wrought products, scrap material was set aside during fabrication for input material to an investment-cast version of the plier jaws. Resulting products were evaluated by metallography and tensile testing.

RESULTS

Oxidation of TiZrNb alloys at 600°–850° C.

Table I presents calculated and actual chemical composition of the initial set of 20 cast buttons.

Oxidation weight gains (mg/dm2) are presented in Table III for the initial 20 buttons, whereas only qualitative ratings for ignitability of the six additional compositions of Table II are presented in Table IV. Blank entries in Table III indicate that either catastrophic ignition of the sample occurred during the test, or that earlier cycles of lesser severity had resulted in ignition, eliminating the need for further evaluation.

FIGS. 1 and 3 present comparisons between oxidation rates of Nb-containing alloys and corresponding binary TiZr alloys at 700° C. and 800° C.

Figure 4:
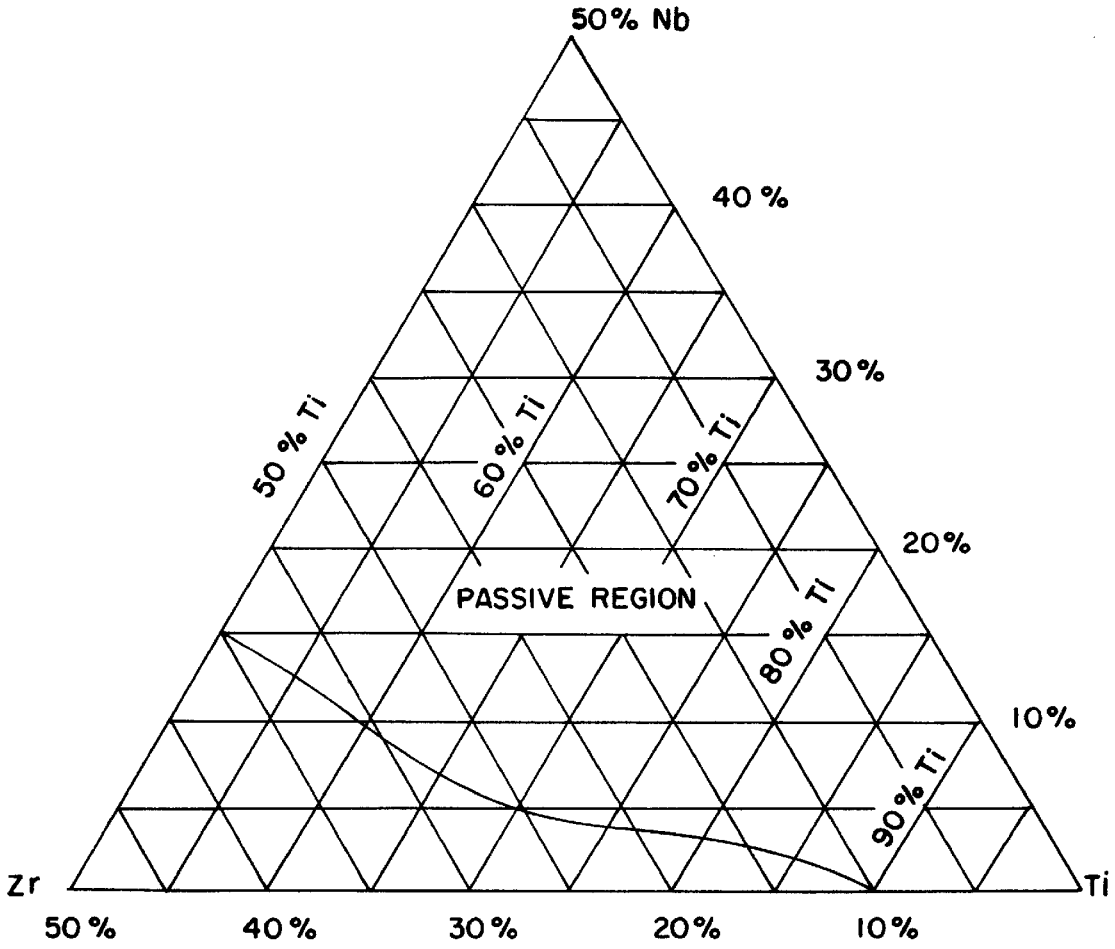
FIG. 4 is a Ternary Oxidation Diagram showing in atomic percentages the passivation range of titanium rich, zirconium alloys passivated by the addition of various amounts of niobium.

A ternary oxidation diagram is presented in FIG. 4, which separate Zr—Ti—Nb alloys into primary categories of "ignitable" and "passive" behavior. Data points obtained from the alloys identified in Tables I and II were used to generate the areas and boundary lines.

TABLE III

| | Oxidation Weight Gain Data (Units: mg/dm$^2$) | | | | | | | | | | | | | | |
|---|---|---|---|---|---|---|---|---|---|---|---|---|---|---|---|
| | 600 | | | 650 | | | 700 | | | 750 | | | 800 | | |
| | 10 | 20 | 30 | 10 | 20 | 30 | 10 | 20 | 30 | 10 | 20 | 30 | 10 | 20 | 30 |
| | 192 | 466 | 1029 | — | — | — | — | — | — | — | — | — | — | — | — |
| 2A | 127 | 288 | — | 196 | — | — | — | — | — | — | — | — | — | — | — |
| 2B | 125 | — | 314 | — | — | — | — | — | — | — | — | — | — | — | — |
| 3 | 34 | 138 | 25 | 94 | 200 | 303 | — | — | — | — | — | — | — | — | — |
| 4 | 112 | — | — | — | — | — | — | — | — | — | — | — | — | — | — |
| 5 | 78 | — | — | — | — | — | — | — | — | — | — | — | — | — | — |
| 6 | 55 | 219 | 241 | 168 | — | — | — | — | — | — | — | — | — | — | — |
| 7 | 25 | 88 | 104 | 105 | 242 | 428 | 279 | 508 | — | — | — | — | — | — | — |

TABLE III-continued

| | Oxidation Weight Gain Data (Units: mg/dm$^2$) | | | | | | | | | | | | | | |
|---|---|---|---|---|---|---|---|---|---|---|---|---|---|---|---|
| | 600 | | | 650 | | | 700 | | | 750 | | | 800 | | |
| | 10 | 20 | 30 | 10 | 20 | 30 | 10 | 20 | 30 | 10 | 20 | 30 | 10 | 20 | 30 |
| 8 | 18 | 58 | 66 | 39 | 89 | 136 | 100 | 216 | 354 | 341 | 552 | 791 | 466 | 771 | |
| 9 | 13 | 44 | 49 | 28 | 72 | 110 | 84 | 180 | 259 | 254 | 440 | 579 | 371 | 575 | |
| 10A | 102 | — | — | — | — | — | — | — | — | — | — | — | — | — | — |
| 10B | 136 | — | — | — | — | — | — | — | — | — | — | — | — | — | — |
| 11 | 108 | 215 | — | — | — | — | — | — | — | — | — | — | — | — | — |
| 12A | 61.7 | — | — | — | — | — | — | — | — | — | — | — | — | — | — |
| 12B | 24.8 | 123 | 75 | 84 | — | — | 161 | — | — | — | — | — | — | — | — |
| 13 | 40 | 178 | — | 117 | — | — | — | — | — | — | — | — | — | — | — |
| 14A | 149 | — | — | — | — | — | — | — | — | — | — | — | — | — | — |
| 14B | 159 | — | — | — | — | — | — | — | — | — | — | — | — | — | — |
| 15A | 32 | 111 | 80 | 68 | 202 | 305 | 201 | 495 | — | — | — | — | — | — | — |
| 15B | 31 | 133 | 70 | 41 | 216 | 306 | 237 | 656 | — | — | | | | | |
| Zr | 4.3 | 16 | 21.7 | 17.4 | 41.1 | 51.1 | 44.6 | 65.1 | 78.3 | 74.8 | 94.6 | 120.9 | 107.3 | 144.5 | 179.4 |
| Hf | 0 | 0 | 1.2 | 0.8 | 4.3 | 4.3 | 4.7 | 6.2 | 11.2 | 0 | 12.0 | 15.5 | 14.0 | 20.2 | 26.0 |
| Ti | 0.4 | 1.6 | 0 | 0.8 | 4.3 | 4.3 | 4.2 | 6.2 | 8.9 | 12.8 | 16.7 | 23.6 | 20.2 | 31.4 | 47.3 |
| Nb | No data | 371 | 88 | 158 | 226 | 181 | 371 | 489 | 415 | 618 | 864 | 668 | 1062 | 1316 | |

TABLE IV

Oxidation Behavior of Additional Alloys

| Alloy | Ignition, Temp., °C. | Ignition Time, min. | Comments |
|---|---|---|---|
| 16 | None observed to 800° C. | — | Uniform oxidation |
| 17 | None observed to 800° C. | — | Uniform oxidation |
| 18 | None observed to 800° C. | — | Uniform oxidation |
| 19 | 800° C. (specimen displayed elevated temperature but no spalling) | | |
| 20 | 650° C. | 15 | Combusion ceased after removal |
| 21 | 650° C. | 10 | Combusion continued after removal |

Biomedical Materials

The Ti—Zr alloys and their surface oxidation products exhibit many of the properties sought by the biomedical community for use in implanted prosthetic devices. Some of these properties are well known e.g. low toxicity, high-corrosion resistance, high strength, etc., It is desirable also to be able to match elastic modulus of implanted materials more closely to that of bone, and to provide porous surfaces to which tissue may bond by "ingrowth". At the present time, five metallic elements (Ti, Zr, Ta, Nb and Pt) have been demonstrated to have little or no adverse effects when implanted.

In reviewing the literature addressing metallic orthopedic implants, it is evident that in the past a wide variety of material and design selections have been utilized. Some examples involve the indiscriminate mixing of components such as screws and pins made of different alloys. This of course resulted in galvanic corrosion of the more anodic components as would be expected of dissimilar metals in the presence of an electrolyte (i.e., body fluids). Such corrosion is not only detrimental from the standpoint of reduced strength in the prosthesis, but also from release of corrosion products (metallic ions and inorganic debris) into the human body. In some cases, intimate contact of the dissimilar metals is not necessary for galvanic corrosion to occur. It is sufficient to merely locate such materials in the same local region of the body.

Ranking the suitability of various alloys for implant use by means of both in vitro and in vivo corrosion evaluations has shown that corrosion resistance increases in the order of 316L, Co—Cr alloys,and Ti6Al4V, all of which are presently widely utilized for implants. Another means of ranking materials, is to study electrochemical effects on biocompatibility, as determined by actual healing in human bone. When current densities in fast-reacting redox system, $K_4[Fe(CN)_6]/K3\text{-}[Fe(CN)_6]$ were measured, gold was highest, followed by stainless steel, Co—Cr,and Ti6Al4V. The same order was noted in observing the degree of disturbance in the initial bone healing process; i.e., gold interfered with healing to the greatest degree, while Ti6Al4V caused very little interference. The explanation which has been offered for these results is that surface oxides formed on some of these alloys are believed to serve to prevent the exchange of electrons and thereby suppress redox reactions at the implant surface. All of the alloys mentioned above owe their corrosion resistance to the presence of protective oxide films which serve as barriers to further diffusion of a variety of chemical species. There have been many successful techniques for imparting protective oxide films to such materials including Ti—Zr alloys. Destruction of these protective films by, for example, mechanical abrasion and the ease with which films reform are important factors in their selection for such uses.

It has been demonstrated that there is a transition from corrosion control to electron exchange control of polarization resistance during spontaneous passivation of film-forming alloys. An extremely complex series of transient conditions may therefore be encountered when abrasive wear and subsequent reformation of the passivating film are considered. Abrasion may not only degrade corrosion resistance but may also result in deposition of debris in joints. This is the primary reason that Co—Cr alloys are presently utilized for knee joint prostheses, whereas Ti6Al4V may be superior in hip joint replacements which do not involve such severe shear/abrasion stresses. Because of the poor resistance to "fretting wear" displayed by conventional Ti alloys, a demonstrable need exists for a titanium containing alloy which is capable of having formed thereon a protective oxide surface layer which is capable of resisting abrasive, fretting wear.

Referring to FIG. 21 and the photo-micrographs, a typical Ti—Zr alloy containing more than about 10–20 wt % Zirconium will have the undesirable ignitable property described herein unless that rapid oxidation behavior is moderated with the addition of small amounts of niobium, tantalum or vanadium. These ignitable alloys have previously been unsuitable for many uses, in particular in the fabrication of metal prosthetic devices, and the study of their other properties has therefore been largely ignored.

While there are many schemes to provide passive oxide surfaces on the non-ignitable alloys containing Titanium and Zirconium only alloys containing Ti—Zr—Nb that contained less than about 20 wt % Zr have been reported. The surface oxides formed have been imparted by molten salt baths and the like which results in a very thin layer to resist abrasion in use. A typical alloy that forms such a surface layer of oxide is Zr 13 wt. % Nb 13 wt % balance titanium. A. K. mishra et al in "Diffusion Hardening: A New Surface Treatment to Prevent Black Debris Formation in Titanium Alloys" at page 595 of "40th Annual Meeting, Orthopaedic Research Society, February 21–24, New Orleans, La." discuss a low modulus titanium alloy Ti-13Nb-13Zr developed for orthopaedic applications. Upon oxidation the ceramic surface obtained was 0.2 to 0.8 micron thick. Samples of this material, Ti, Zr, and the 3510 alloy of the present invention were measured for oxidative weight gain and the results are set forth in Table V.

TABLE V

Oxidation Weight Gain Data in mg/dm$^2$

| Temp °C. | 650 | 700 |
|---|---|---|
| Time min | 30 | 30 |
| 3510 | 110 | 259 |
| Ti-13Zr-13Nb | 8.8 | 20.9 |
| Ti | 5 | 10.1 |
| Zr | 51 | 78 |

From Table V the Ti-13Zr-13Nb is seen to be similar to Ti in that it oxidizes slowly at 650° C. and 700° C. in air. When it was heated for 17 hours at 1400° C. it did not fully oxidize as does 3510. The Ti-13Zr-13Nb oxide was fractured and non-adherent.

Figure 6:
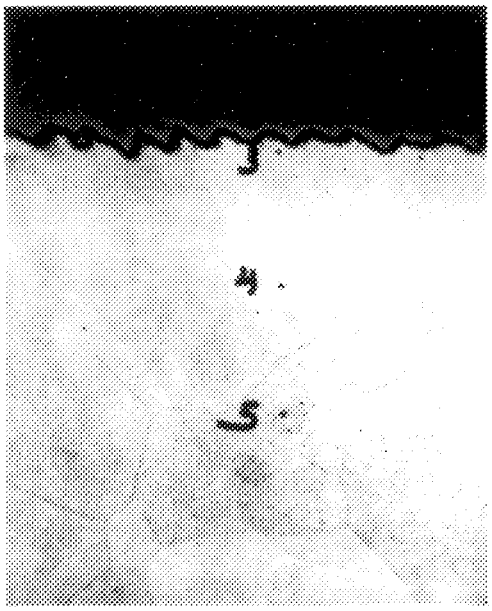
FIG. 6 is a photomicrograph of a tilted sample of passivated Ti—Zr—Nb alloy according to this invention that has been oxidized in air for 10 minutes at 750° C. showing the surface of the sample.
Figure 8:
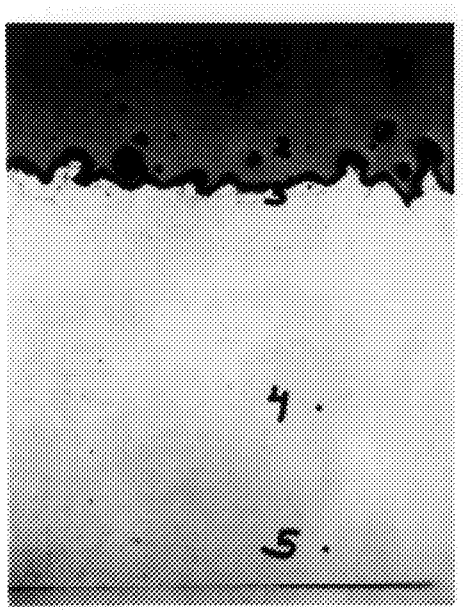
FIG. 8 is a photomicrograph of a tilted sample of passivated Ti—Zr—Nb alloy according to this invention that has been oxidized in air for 30 minutes at 750° C. showing the surface of the sample.
Figure 9:
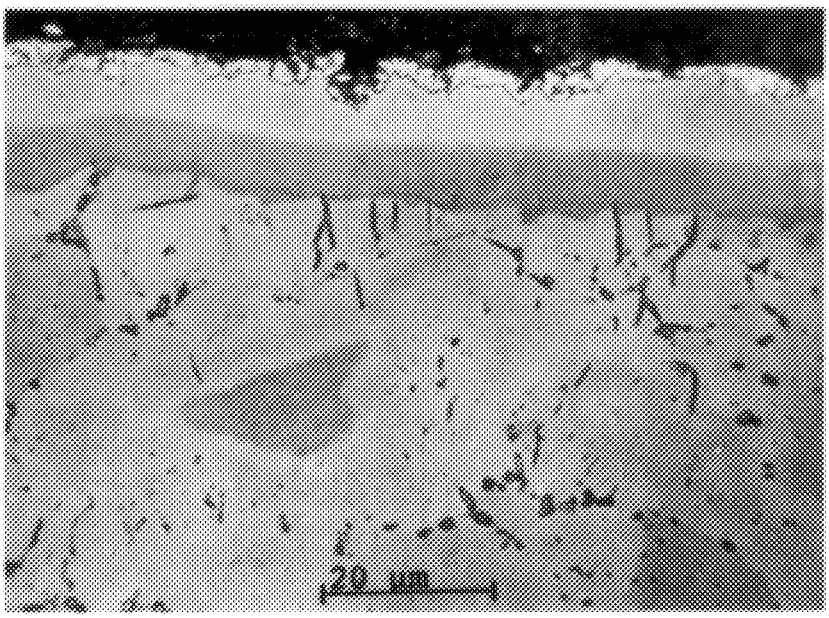
FIG. 9 is a photomicrograph of pure Zirconium nitrided for one hour at 1200° C.
Figure 10:
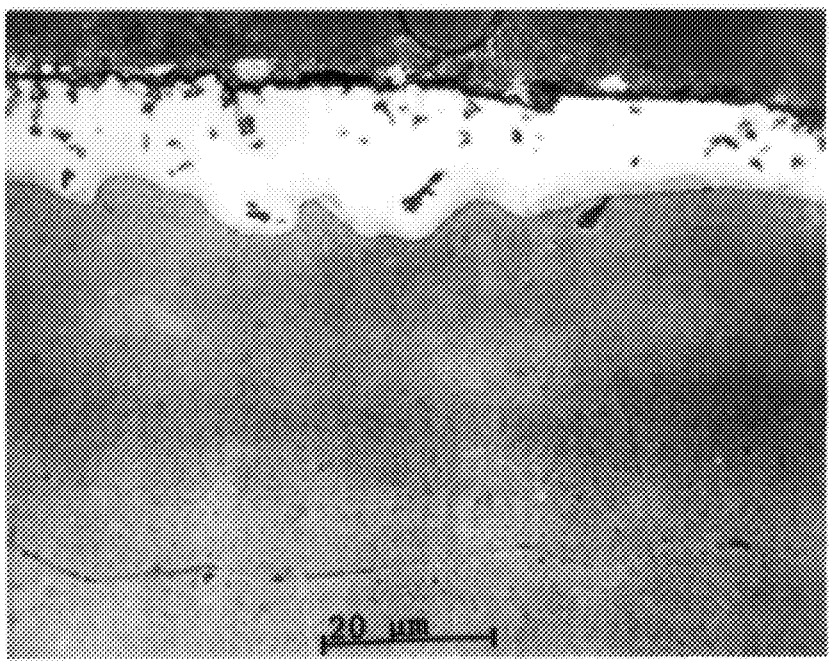
FIG. 10 is a photomicrograph of titanium nitrided for one hour at 1200° C.
Figure 11:
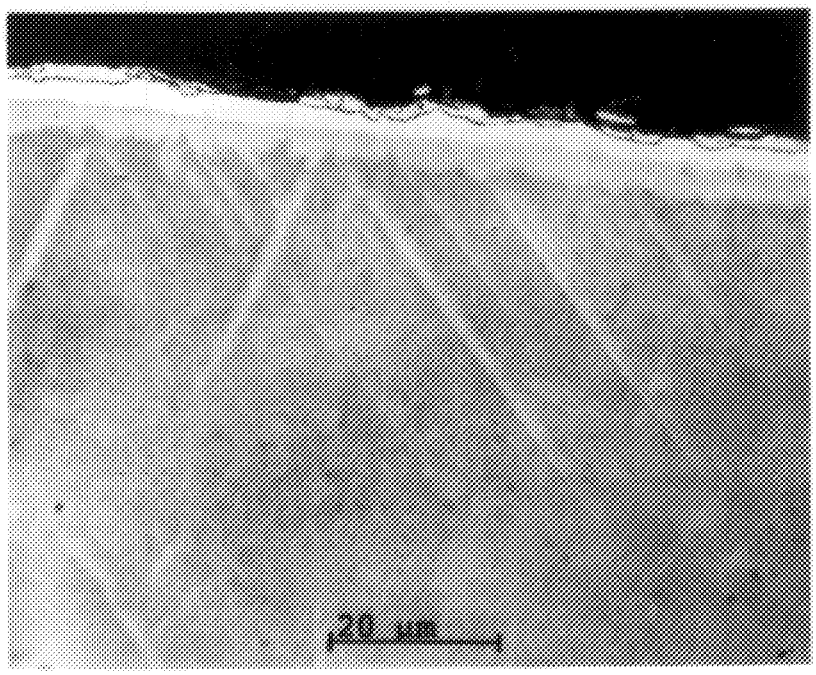
FIG. 11 is a photomicrograph of a passivated Ti—Zr—Nb alloy according to this invention that has been nitrided for one hour at 1200° C.
Figure 12:
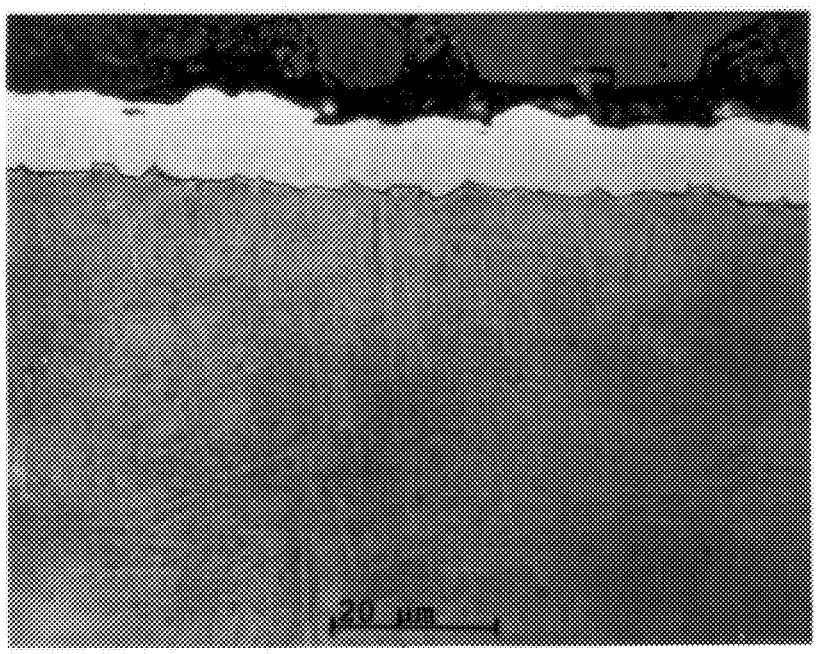
FIG. 12 is a photomicrograph of a passivated Ti—Zr—Nb alloy according to this invention that has been nitrided for six hours at 1200° C.

The exemplary TiZrNb alloy described herein i.e. 35 wt % Zr 10 wt % Nb when oxidized for short times at various temperatures in air, produces a thick monolithic adherent oxide layer in the surface of the metal. For example, FIG. 6 shows oxidation for 10 minutes at 750° C., FIG. 7, 20 minutes at 750° C. and FIG. 8, 30 minutes at 750° C. The resultant oxide surface layer shown in each photograph is dense and adherent. Other oxidation behavior was also studied. FIG. 9 shows a nitride layer on pure Zirconium formed after 1 hour at 1200° C. FIG. 10 shows a nitride layer on pure Titanium formed after 1 hour at 1200° C. These two layers can be visually compared with a nitride layer on 35 Zr 10 Nb wt % formed after 1 hour at 1200° C. (FIG. 12).

An additional value is obtainable from the alloys and products of the present invention because of the low modulus of elasticity that can be achieved with these alloys. Low modulus materials are now preferred for the following reasons.

Because of problems in attaching prostheses to bone with adhesives, a trend has developed toward the use of cementless, interference fit methods.

Viewing the human femur from the front or rear, a significant curvature (concave downward) is noted as the bone deviates from the generally straight lower segment of the femur toward the hip socket. In a normal bone, the body's weight tends to flex this region so that the curvature increases as weight is shifted to that side of the body. The Young's elastic modulus of cortical bone is about 31 GPa (4.5 Mpsi), far below values for common engineering alloys. When a relatively stiff prosthesis is inserted into the intramedullary canal of the femur, the curved region in question may become "shielded" from flexural stresses. As is true of other biological structures (e.g., muscles), the absence of stress and flexure may result in a form of atrophication. In the specific case of bone "shielding", the body resorbs and weakens the bone, which may ultimately cause loosening or fracture of the prosthetic stem. Attempts to design the prosthesis so that the curved region of the femur experiences increased stresses by increasing the length of the curved neck have created excessive moments at other points, causing fractures. A logical approach to this problem would appear to be to develop suitable alloys with lower elastic modulus values, while preserving adequate strength, corrosion resistance and other required attributes.

Significant reduction in bone resorption have been demonstrated in dogs and sheep with low modulus hip implants. Finite element analyses have also confirmed that healthy femurs are more closely simulated by low modulus materials. Strain gauge analyses have also confirmed this finding. In human patients, bone resorption, loosening, and the pain which has clearly been attributed to excessive prosthetic stiffness has been shown to be reduced in frequency and severity by using low modulus hips. Metallic materials are felt to be preferable to other materials, such as polymer composites, because of cost considerations and the poor wear resistance of these composites.

Titanium alloys recently promoted for medical prosthetics include Ti5Al2.5Fe, Ti6Al7Nb and Till.5Mo6Zr2Fe. The first two of these still have relatively high modulus (105–115 GPa versus 120 GPa for Ti6Al4V) and contain the potentially undesirable element aluminum. The second contains relatively high concentrations of Mo and Fe, both of which have been demonstrated to cause severe tissue reactions. The alloys of the present invention contain only biocompatible elements and are therefore more desirable.

As will be more fully described hereinafter, the partial or complete conversion at higher temperatures, of the alloys of the present invention into their corresponding oxides and mixed oxides in the form of a reaction formed ceramic can also be useful as materials for prosthetic devices due to the inert character of the ceramic, the various pore sizes obtainable that may promote tissue ingrowth and the physical properties of the underlying metal in the case of partial conversion to ceramics, etc.

Ceramics formed from the subject TiZrNb alloys will be of interest as replacements or reinforcements for bone and teeth. Various other approaches to obtain porous ceramic structures into which bone may grow to form stable interfaces have been evaluated. These include sintered powders, foamed ceramics, preferential etching to remove included phases, and calcining natural materials such as coral. It has been found that controlling pore size and uniformity is essential to obtain optimum properties in these materials. Bone ingrowth requires pore diameters of at least 100 $\mu$m in order for nourishment to be continuously supplied to living cell structures, while excessive porosity or unnecessarily large pore diameters tend to weaken the ceramic prosthesis. The homogeneous distributions of predicatably uniformly-sized grains and pores associated with oxides formed from the subject TiZrNb alloys makes them desirable for such medical use.

Materials for Cutlery

Although wear resistance may be a primary consideration in selecting materials for cutlery implements, other properties such as fracture toughness, strength, and elastic modulus are also important. The poor corrosion resistance of plain carbon and low alloy steels resulted in large commercial markets for a martensitic class of stainless steels which is generally described by the relationship % Cr-(17X % C)<12.5. These alloys are capable of transforming from austenite to martensite upon quenching to yield relatively high hardness (50–55 $R_c$), whereas alloys in which % Cr-(17X % C)>12.5 are strictly ferritic and are therefore not hardenable.

Recent interest in reducing weight in cutlery items has resulted in evaluation of titanium-based alloys. There are also special applications in which increased corrosion resistance in seawater and other chemical environments make titanium a potentially desirable material. Certain military applications require materials which are non-magnetic and low in surface reflectivity, or which do not display ductile-to-brittle transitions at low temperature. Still, other applications require high impact resistance or low elastic modulus to increase flexibility in such implements as fileting knives.

Although many of these desired properties may be provided by conventional titanium alloys such as Ti6Al4V, adequate hardness for cutting edges is difficult and expensive to obtain, often involving surface diffusion processes conducted for long times at high temperatures and in special environments such as autoclaves. Furthermore, the hard surface films (e.g., oxides, nitrides, carbides, borides) are impossible for the consumer to repair when resharpening becomes necessary. The oxidation characteristics of the subject TiZrNb alloys offers a potential solution to these problems.

It should be noted that many considerations applicable to consumer goods such as high-volume cutlery are non-technical in nature. A sportsman, for example, may prefer a softer knife which is easily sharpened to one which will "hold an edge" longer, while a housewife may prefer a kitchen knife which is not overly sharp and which does not need frequent sharpening.

Figure 13:
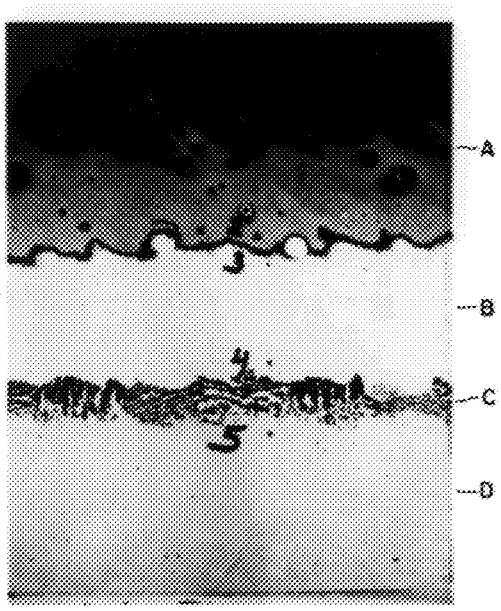
FIG. 13 is a photomicrograph of a tilted sample of passivated Ti—Zr—Nb alloy according to this invention which has been oxidized in air for 10 minutes at 800° C. showing the surface of the sample.

The morphology of the transformation of the Ti—Zr alloys which have been rendered non-ignitable according to this invention, into ceramic oxides is complex and not easily described. Referring again to the photomicrographs, FIG. 13 shows a photomicrograph of a tilted sample of the typically examined 35Zr10Nb alloy oxidized in air for 10 minutes at 800° C. This is a temperature only slightly higher than the 750° C. results shown in FIGS. 6–8 for the same time. The surface of the oxide layer is shown at A, B is the oxide layer itself, C is an area of mixed oxide and metal phases and D is alpha oxygen stabilized metal alloy.

Figure 14:
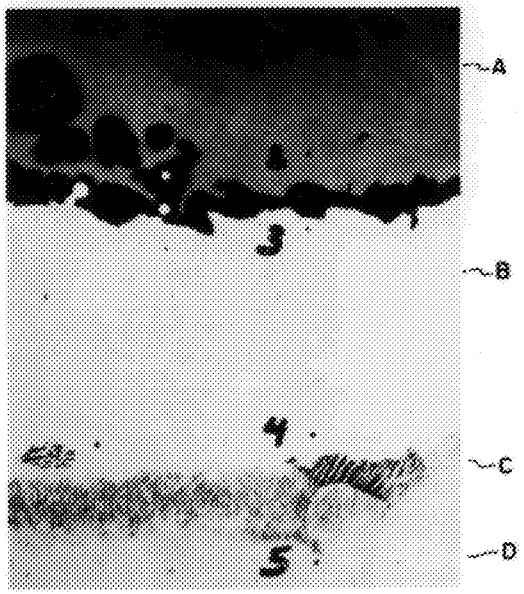
FIG. 14 is a photomicrograph of a tilted sample of passivated Ti—Zr—Nb alloy according to this invention which has been oxidized in air for 30 minutes at 800° C. showing the surface of the sample.
Figure 15:
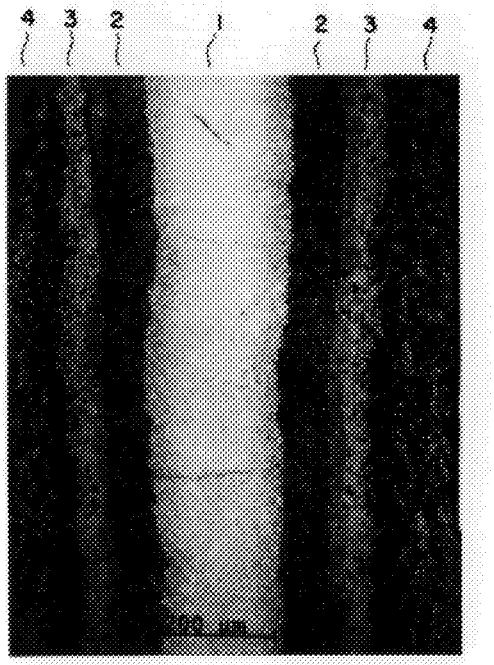
FIG. 15 is a photomicrograph of a thin metal section of a passivated Ti—Zr—Nb alloy according to this invention which has been oxidized in air at 1300° C.
Figure 19:
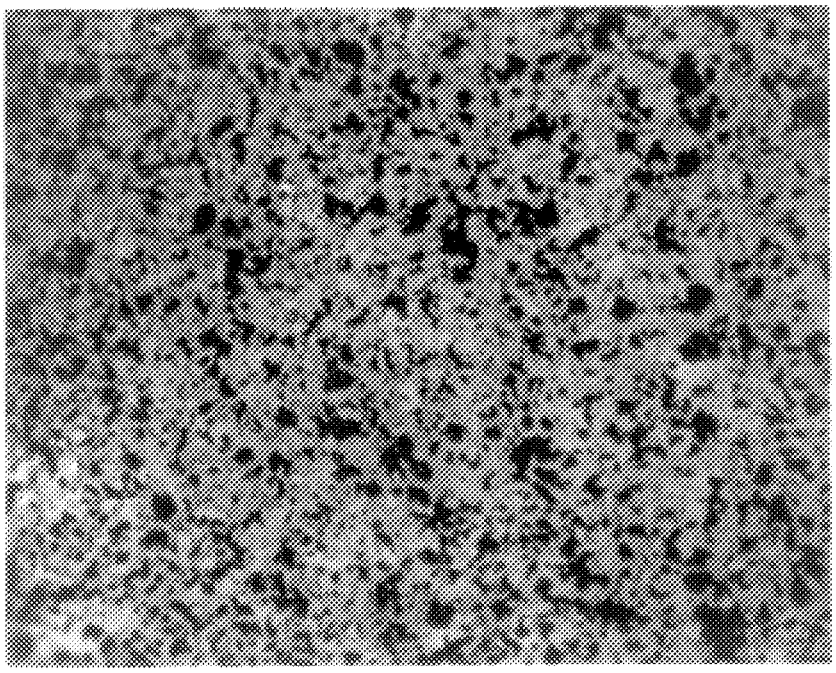
FIG. 19 is a 200 power photomicrograph of a ceramic formed according to the present invention at 1400° C.
Figure 20:
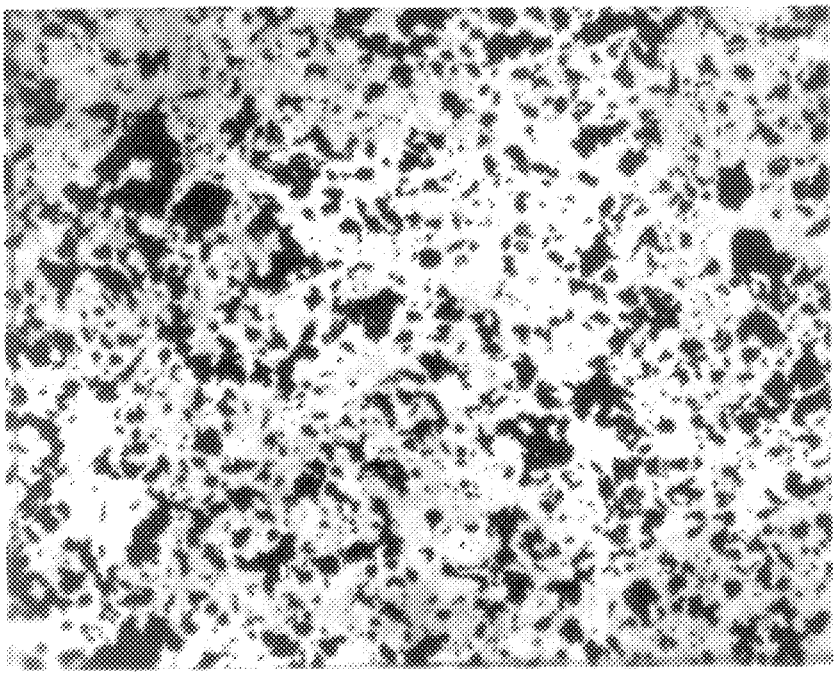
FIG. 20 is a 200 power photomicrograph of a ceramic formed according to the present invention at 1500° C.

Referring to FIG. 14, the same metal alloy is shown after oxidation in air for 30 minutes at 800° C. The surface of the oxide layer A is still visually well characterized. The oxide layer B is larger as is the mixed oxide and metal zone C. The alpha-stabilized zone D is still evident. In FIG. 15, a sample of 35Zr10Nb was oxidized in air at 1300° C. A much more complex picture of the conversion process is developed here. The metal substrate 1 originally was nearly as thick as the resultant oxide covered structure. The first layer, or zone, of oxide material 2 remains rich in niobium and is believed to be comprised of several oxide or suboxide species. The next layer 3 moving outward from the metal represents a transformation zone where conversion to the final oxide specie found in the outer surface 4 is taking place. Pores are being formed in layer 4 possibly as a result of this conversion process and larger pores form where the conversion is carried out at higher temperatures. FIG. 19 and FIG. 20 show respectively under 200 power magnification that the dark areas (pores) are smaller where the temperature of formation was 1400° C. (FIG. 19) than the larger pores formed at 1500° C. (FIG. 20). This ability to form uniformly distributed pores and to control the pore size by adjusting the temperature of the ceramic oxide formation while maintaining nearly constant pore volume percent porosity, can be useful in the fabrication of many articles including catalyst supports and the like where pore sizes is important to the intended performance of the finished article.

Figure 7:
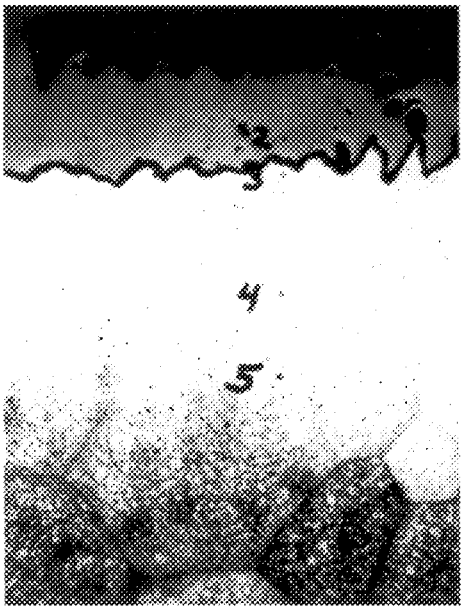
FIG. 7 is a photomicrograph of a tilted sample of passivated Ti—Zr—Nb alloy according to this invention that has been oxidized in air for 20 minutes at 750° C. showing the surface of the sample.
Figure 16:
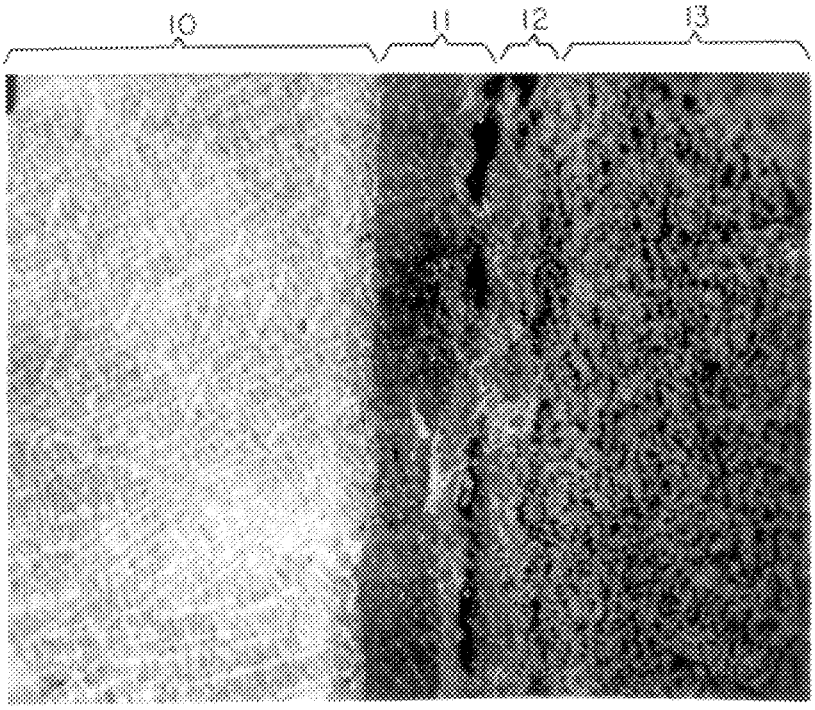
FIG. 16 is a photomicrograph of an alloy of the present invention oxidized in air at 1200° C. for 24 hours.
Figure 17:
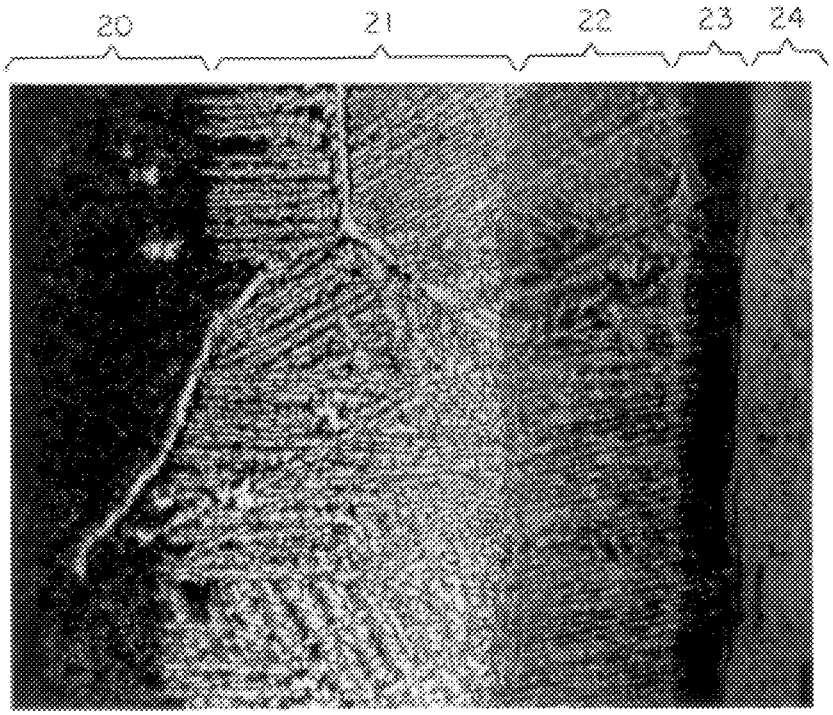
FIG. 17 is a photomicrograph of an alloy of the present invention oxidized in air at 1000° C. for 39 hours.

FIGS. 16 and 17 visually show that the adjustment of both time and temperature can be critical to different results being obtained in the final oxidized product. While oxide layer formation such as shown in FIGS. 6–8 can be achieved at relatively low temperatures and only short times, modestly higher temperatures and longer times produce radically different phenomenon. In FIG. 16 the metal substrate 10 was subjected to oxidation at 1000° C. for 39 hours. The 200 power photomicrograph shows the metal 10 with two visually identifiable intermediate zones or areas 11, and 12 underlying the final oxide 13.

In FIG. 17 the metallic substrate has at least three visually identifiable zones 21, 22 and 23, underlying the final oxide layer 24. Zone 21 appears to be a metallic zone with internal and grain boundary oxidation. FIG. 17 is a 200 power photograph of a 35Zr10Nb sample oxidized at 1000° C. for 39 hours.

Figure 18:
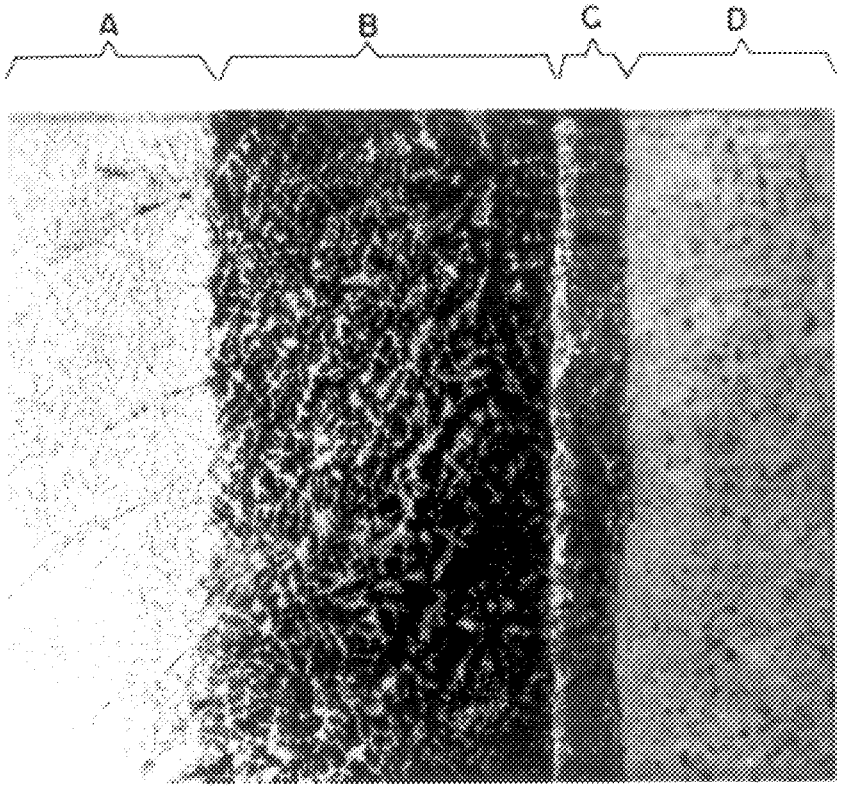
FIG. 18 is a photomicrograph of an alloy of the present invention oxidized in air at 1100° C. for 64 hours.

FIG. 18 is yet another example of the possible variations in the morphology of formation of the ceramic described herein. The 35 Zr10Nb alloy was oxidized in air for 64 hours at 1100° C. The 200 power photomicrograph clearly shows a metallic zone A, an oxygen stabilized metallic zone B and an intermediate zone C containing mixed oxide phases and the surface oxide D.

Referring to FIG. 5 a very complex spectrum of possible oxide species are possibly formed during the ceramic conversion process.

The present studies of oxides formed at 1400°–1500° C. confirm the presence of $TiO_2$ (rutile form) which contains an appreciable amount of Nb, and a Zr-rich phase (probably $TiZrO_4$) which contains only a trace of Nb. The moderated oxidation rate of 35Zr10Nb may therefore be attributable to some ability of Nb to prevent interactions between the Zr-rich and Ti-rich phases which could otherwise lower the monoclinic←→tetragonal zirconia transformation temperature.

As previously described, tantalum and vanadium have been successfully substituted in the alloy of the present invention for the niobium, likewise the nitridation of the alloys reacts generally similarly and produces results similar to the air oxidation described herein.

Alloys of the present invention can be processed to produce different physical properties. The following shows the change in tensile strength as the material is worked and given heat annealing. A sample of 3510 alloy described herein was heated to 675° C. and heated in a salt bath with water quench. The results are presented in Table VI in the row labelled Initial. The initial material had an ultimate tensile strength of 121.4 Kpsi with additional characterizations given in the Table. Then various heat treatments were given.

TABLE VI

| Temp °C. | Time Hr | TYS | % Elog | % ROA | E × $10^6$ |
|---|---|---|---|---|---|
| Initial | | 48.6 | 26 | 62 | 8.0 |
| 450 | 3 | 149.3 | 8 | 29 | 10.8 |
| | 6 | 149.0 | 10 | 36 | 11.0 |
| | 10 | 147.5 | 9 | 31 | 11.0 |
| 500 | 1 | 138.0 | 13 | 47 | 10.7 |
| | 3 | 133.9 | 13 | 54 | 10.9 |
| | 6 | 130.7 | 15 | 67 | 11.1 |
| | 10 | 129.2 | 15 | 58 | 10.6 |
| 550 | 1 | 117.9 | 15 | 56 | 10.3 |
| | 3 | 114.2 | 15 | 56 | 10.4 |
| | 6 | 110.6 | 17 | 59 | 10.2 |

where
TYS is the tensile yield strength in Kpsi units
% Elog is the percent elongation
% ROA is the percent reduction of area
E is the Youngs Modulus From Table VI it is seen that the initial tensile yield strength of 48.6 can be increased to 149.3 by heat treating at 450° C. for 3 hours.

swaged and then given the same heat treatment the tensile strength was 160.2. Similarly, for an aging treatment at 500° C. in Table VI for 6 hours the tensile strength was 130.7. When the material was swaged and given the same aging treatment the tensile strength increased to 137.7.

To determine the effect of 11% Nb (wt. %) to a wide range of compositions samples were tested as follows. Arc-melted buttons of ten different compositions ranging from a Ti content of 10–69% (wt. %) were fabricated where each one had 11 wt. % Nb. They were cold rolled/annealed to a 0.1 inch strip. Samples of each were oxidized for 45 minutes in air at temperatures of 350°, 400°, 450° and 500° and 550° C. Additional samples of each alloy which had been water quenched (WQ) from a 677° C. salt bath, were oxidized for 45 min. at 425° C. and 550° C. The results for these 70 specimens are in Table VIII.

TABLE VIII

| | | Weight Gain, mg/dm$^2$ for 45 minutes | | | | | | |
|---|---|---|---|---|---|---|---|---|
| | | Temperature °C. | | | | | | |
| Alloy | Composition Wt % | 350 | 400 | 425 WQ | 450 | 500 | 550 WQ | 550 |
| 1 | 10Ti–79Zr11Nb | 10.4 | 20.3 | 70.5 | 97.4 | 304.9 | 304.9 | 262.9 |
| 2 | 15Ti–74Zr11Nb | 4.9 | 8.1 | 48.1 | 70.4 | 244.3 | 244.3 | 185.9 |
| 3 | 20Ti–69Zr11Nb | 2.4 | 10.3 | 22.0 | 53.7 | 105.0 | 245.3 | 197.1 |
| 4 | 25Ti–64Zr11Nb | 2.6 | 7.1 | 14.6 | 28.2 | 76.3 | 200.1 | 190.6 |
| 5 | 30Ti–59Zr11Nb | 2.5 | 8.0 | 11.7 | 20.1 | 64.7 | 165.8 | 200.8 |
| 6 | 35Ti–54Zr11Nb | 3.0 | 3.9 | 7.2 | 20.8 | 47.4 | 146.2 | 140.4 |
| 3510 | 54Ti–35Zr11Nb | 2.3 | 1.1 | 4.8 | 8.7 | 12.9 | 14.5 | 18.1 |
| 8 | 59Ti–30Zr11Nb | 1.9 | 3.5 | 1.2 | 12.5 | 21.2 | 17.3 | 27.1 |
| 9 | 64Ti–24Zr11Nb | 0 | 2.4 | 4.2 | 10.6 | 14.8 | 14.8 | 16.5 |
| 10 | 69Ti–20Zr11Nb | 0 | 2.1 | 1.3 | 10.5 | 7.7 | 7.7 | 7.7 |

There can be additional improvements in properties by forging the alloy. The rods from Table VI above were further swaged. To protect the metal from oxidation and possible burning during the metal forming operation, the metal surface can be coated with a protective glass composition such as Metal Guard 101 from Metalube Corp. The improved properties are set forth in the Initial row of Table VII. The tensile yield strength had been increased to 154.4. Then additional heat treatments were given and the results are set forth in Table VII.

TABLE VII

| Temp °C. | Time Hr | TYS | % Elog | % ROA | E × $10^6$ |
|---|---|---|---|---|---|
| Initial | | 157.4 | 13 | 58 | 7.4 |
| 450 | 3 | 167.7 | 12 | 44 | 9.9 |
| | 6 | 163.5 | 13 | 53 | 10.8 |
| | 10 | 160.2 | 14 | 55 | 10.4 |
| 500 | 1 | 149.5 | 15 | 59 | 10.9 |
| | 3 | 141.8 | 17 | 62 | 10.8 |
| | 6 | 137.7 | 19 | 64 | 10.4 |
| | 10 | 133.1 | 19 | 63 | 10.1 |

Again by heat treating at 450° C. the tensile strength can be increased to 167.7. The improvement by swaging can be seen by comparing the data in Tables VI and VII. For an aging treatment in Table VI at 450° C. for 10 hours the tensile strength was 147.5. When the material was further From Table VIII it is seen that only alloys Nos. 8, 9 and 10 as well as alloy 3510 were passive enough to resist exothermic behavior when heated in air between 635° and 700° C. during fabrication.

From this low temperature (350°–550° C.) oxidation it is seen that the maximum oxidation rate occurs as quite low Ti content on the order of about 5–10%. This is in contrast with the behavior of binary Ti—Zr alloys for which a maximum occurs at about 60–80 wt. % Ti. These binary alloys have oxidation rates at 500°–600° C. of about 1,000 times higher than Nb-containing counterparts.

Solution quenching from 677° C. prior to oxidizing at 425° C. and 550° C. did not appear to significantly affect oxidation behavior in any of the alloys studied.

From Table VIII it is seen that alloys with oxidation behavior similar to that of alloy 3510 may be obtained at somewhat higher Ti levels. There is expected to be an upper limit for the Ti content where the oxides would have poor wear resistance. It appears that wear-resistant oxides could be expected in alloys having about 11 wt % Nb when the Zr is in the range of about 20–35%. Also, increasing Zr within this range will increase the rate of oxidation which may be desirable for production costs.

Various Ti—Zr compositions containing 11 wt % Nb were tested for hardness. The study also showed that as the Ti concentrations change in these alloys, there is a change in the oxide scale morphologies. The alloys were each heat treated for one hour at 1400° C. Oxide scale samples were collected or scraped off each sample, ground with a mortar and pestle and mounted using NaF as the backing material. For each sample a test piece was cut from the specimen and the sample cross section was mounted in a transparent mount and brought to a 1 micron finish. The samples were tested for hardness using a Vickers indenter on a LECO micro-hardness tester. The results are presented in Table IX.

TABLE IX

Hardness Variations in Ti—Zr—Nb Compositions

| Alloy | Composition wt % | Central | Intermediate | Outer |
|---|---|---|---|---|
| 1 | 79Zr-10Ti-11Nb | 864 | 1400 | |
| 2 | 74Zr-15Ti-11Nb | | 1047 | |
| 3 | 69Zr-20Ti-11Nb | 1320 | 1197 | |
| 4 | 64Zr-25Ti-11Nb | | 576 | 292 |
| 5 | 59Zr-30Ti-11Nb | 1220 | 1150 | 289 |
| 6 | 54Zr-35Ti-11Nb | 1511 | 1217 | |
| 7 | 35Zr-54Ti-11Nb | 1391 | 1498 | |
| 8 | 30Zr-59Ti-11Nb | 5155 | 2551 | |
| 9 | 25Zr-64Ti-11Nb | 1316 | 925 | |
| 10 | 20Zr-69Ti-11Nb | 1281 | 1294 | |

Since these alloys form relatively thin oxide scales, micro-hardness values of the scales are difficult to achieve without getting the mounting surface as well. The data shows the general trend that the intermediate oxide layer has relatively the same or slightly higher hardness than the center base metal.

One of the preferred alloy compositions is referred to as alloy 3510 and it nominally has a composition of 34–36 wt % Zr, about 10 to 11.5 wt % Nb with the balance being Ti. When ingots are made of this alloy they typically have a Brinell hardness of about 296 with a range from about 285 to 306. The alloy can be forged and rolled at temperatures of about 650°–850° C. It can be cold worked with a 40% ROA by cold rolling, a 40% ROA by cold swaging and a 50% ROA by tube reducing. Intermediate annealing between cold reductions has been successfully done such as at 732° C. for 2 hours, at 677° C. for 4 hours in production vacuum furnaces, and at 677° C. for 30–60 minutes in molten chloride salt baths.

The heated alloys can be quenched from temperatures of 677° C. to 850° C. Water temperatures between 70° F. (21° C.) and 200° F. (93° C.) are acceptable for quenching. Aging has been done at 425°–500° C. for times of 2–10 hours with a treatment at 450° C. for 2 hours being adequate. All aging studies have been performed with an air atmosphere which results in a blue-black oxide film.

Surface hardening can be done by heat treatment in oxygen by using air and in nitrogen. The air oxidation surface hardening may be performed at 425°–600° C. for 2–72 hours depending on the oxide depth desired. The color and appearance of the oxidized surface is strongly dependent upon surface preparation. The nitration hardening can be carried out for various times at 1000°–1400° C. in pure nitrogen.

Typical mechanical properties are given in Table X.

TABLE X

Mechanical Properties

| Condition | Temp | UTS ksi | 0.2 YS ksi | % Elong. | $E_o$ psi |
|---|---|---|---|---|---|
| Fully Hardened | R.T. | 165 | 160 | 14 | $10.4 \times 10^6$ |
| Beta Quenched | R.T. | 120 | 50 | 26 | $8.0 \times 10^6$ |

The alloy can be surface oxidized to produce a highly wear resistant surface. Useful applications include prosthetic devices, firing mechanisms in fire arms and large hand tools which can have hardened surfaces with an infinite life span.

The alloy is amenable to hot or warm forging, and particularly closed die forging. Sharp corners, indentations and other details can be accurately produced. This is due to the exhibition of superplasticity by the alloy at a temperature of about 1350° F. (732° C.). The reason for this property is not completely known. One factor contributing to this property, but not the only one, is the low Beta transus temperature of the alloy which is about 635° C. By forming the alloy at the higher temperatures of 1350° F. (732° C.) to 1400° C. (760° C.) the alloy is in the beta phase where it is more easy to form than if it were in the alpha state at the lower temperatures.

Scratch wear tests on the combined material system of the metal alloy and its oxide coating show extremely good wear resistance. The oxide film is very hard and extremely adherent to the metal surfaces. In medium load, low velocity sliding wear conditions, very little wear is observed after 1000 meters. More significant is the effect of the scratch wear tests which indicate that even when the oxide film is fractured and peeled from the regions of the surface, the film retains its integrity. There are no large regions peeled away. These scratch tests are designed to destroy the oxide, yet this goal was difficult to achieve with standard test equipment.

Single and multiple pass scratch tests were performed on the oxidized disk material using different diameter (20, 50 and 200 microns) diamond indenters at different loads of 0.21 to 1.49 kg. The scratch tests produced a wear scar of approximately 5 mm in length. The width of the scar was dependent on the diamond indenter size and the applied load.

When scratching the oxide surface with a 20 micron conical diamond under a load of 0.428 kg (approx. 13.4 GPa surface pressure) there was deformation of the oxide to form a groove along with fracture of the oxide both within the scratch and at the scratch periphery. Although in some regions the oxide has peeled off the surface of the alloy, there is no apparent damage to the metal alloy below.

Scratching the oxide surface with a 50 micron diamond indenter resulted in considerably less damage, even at loads of up to 1.49 kg (approx. 7.5 GPa) surface pressure. At all loads tested, the scratch is quite shallow and is characterized by light deformation and some fracture at the track periphery. At the highest load of 1.49 kg there was no peeling of the oxide away from the alloy surface.

When using a 300 micron diamond indenter it was not possible to generate visible scratches on the oxidized surfaces.

Multiple pass scratch tests were performed using a 200 micron diamond indenter at a load of 0.85 kg (4.3 GPa surface pressure). Following 10 passes, damage is limited to light plastic deformation and occasional fracture and peeling across the scratch width.

Increasing the number of passes to 20 resulted in variable damage across the length of the scratch from regions of fracture and peeling to regions of very minor plastic deformation. Fracture and peeling occurred most frequently in areas of apparent oxide inhomogeneity. In regions of extensive oxide peeling, however, there is no evidence of significant damage to the metal below.

A preferred oxide surface treatment has been devised to minimize the formation of microcracks. Since the rate of formation of the hard sub-oxide layer is lower at lower temperatures of 1200° C. and 1300° C. than at 1400° C., a two-stage heat treatment is employed where the alloy structure is first substantially oxidized at the lower temperature of about 1200° C. for a relatively short period of time such as 2 hours. Then it is heat treated in a second stage for a longer period of time such as from 2 to 12 hours at a higher temperature such as 1350° C. to sinter and densify the oxidized material. The result is a strong oxide coating without large cracks, gross deformation and change in shape of the original starting material. The results of a series of treatments for the alloy 3510 are set forth in Table XI.

Sample 1, which was only given a single heat treatment at 1400° C. resulted in a product with cracks. The remaining samples were made with the two-step procedure and they had no major cracks. As seen in Table XI, the modulus of elasticity values are low and in the range of that for human bones. Samples 5–6 had a relatively high rupture strength. These materials can be used in biomedical systems because of their low moduli and a combination of surface properties which help in tissue growth as well as added strength.

TABLE XI

Effect of Two Step Heating Treatment

| Sample | Heating Conditions (C., hrs) | Max Load (lb) | Rupture Strength (ksi) | Mod. of Elasticity (msi) |
|---|---|---|---|---|
| 1 | (1400, 1.5) | 8.98 | 8.2 | 2.45 |
| 2 | (1200, 2) (1350, 2) | 4.1 | 4.8 | .88 |
| 3 | (1200, 2) (1350, 2) | 5.17 | 8.4 | 1.31 |
| 4 | (1200, 2) (1350, 7) | 3.0 | 3.4 | .6 |
| 5 | (1200, 2) (1350, 12) | 14.55 | 13.6 | 2.56 |
| 6 | (1200, 2) (1350, 12) | 18.65 | 19.1 | 2.74 |
| 7 | (1200, 2) (1350, 12) | 30.18 | 29.5 | 2.91 |

This invention has been described with respect to its preferred embodiments and contemplated utility. Variations can be made without undue experimentation by those skilled in the art with the expected results being obtained without departing from the spirit and scope of the invention described in the appended claims as interpreted in view of the applicable prior art.

We claim:

1. A method of converting a titanium alloy having two additional metals, with a second metal selected from the group consisting of zirconium, hafnium and mixtures thereof and a third metal selected from the group consisting of niobium, tantalum, vanadium and mixtures thereof, said second and third metals being present in atomic % amounts corresponding to the amounts of Zr and Nb, respectively, in the crossed hatched area A in the ternary diagram in FIG. 22, into a mixed oxide containing ceramic material comprising heating the alloy in air to a first temperature to substantially completely oxidize the alloy and then heating the oxidized alloy to a higher temperature for a sufficient period of time to produce a consolidated oxidized material having a Youngs Modulus of elasticity of less than 5 msi.

2. A method of converting a titanium-zirconium-niobium alloy comprising Ti, Zr and Nb compositions defined by the cross-hatched area A in the atomic percent ternary diagram in FIG. 22, into a mixed oxide containing ceramic material comprising heating the alloy in air to a first temperature to substantially completely oxidize the alloy and then heating the oxidized alloy to a higher temperature for a sufficient period of time to produce a consolidated oxidized material having a Youngs Modulus of elasticity of less than 5 msi.

* * * * *